US006518945B1

(12) United States Patent
Pinkham

(10) Patent No.: US 6,518,945 B1
(45) Date of Patent: Feb. 11, 2003

(54) REPLACING DEFECTIVE CIRCUIT ELEMENTS BY COLUMN AND ROW SHIFTING IN A FLAT-PANEL DISPLAY

(75) Inventor: Raymond Pinkham, Los Gatos, CA (US)

(73) Assignee: Aurora Systems, Inc., San Jose, CA (US)

( * ) Notice: Subject to any disclaimer, the term of this patent is extended or adjusted under 35 U.S.C. 154(b) by 0 days.

(21) Appl. No.: 08/901,059

(22) Filed: Jul. 25, 1997

(51) Int. Cl.[7] ..... G09G 3/36

(52) U.S. Cl. ..... 345/92; 345/93; 345/90; 345/87; 345/98; 345/100

(58) Field of Search ..... 345/92, 90, 93, 345/98, 904, 204, 206, 99, 100, 56, 103, 87

(56) References Cited

U.S. PATENT DOCUMENTS

| | | | | | |
|---|---|---|---|---|---|
| 4,368,523 | A | | 1/1983 | Kawate | 365/63 |
| 4,680,580 | A | | 7/1987 | Kawahara | 340/784 |
| 4,789,857 | A | | 12/1988 | Maurice | 340/784 |
| 4,804,951 | A | * | 2/1989 | Yamashita et al. | 340/719 |
| 4,995,703 | A | | 2/1991 | Noguchi | 350/333 |
| 5,018,835 | A | * | 5/1991 | Dorschner | 350/336 |
| 5,113,134 | A | * | 5/1992 | Plus et al. | 324/158 |
| 5,132,677 | A | | 7/1992 | Nicholas | 340/784 |
| 5,204,836 | A | | 4/1993 | Reed | 365/200 |
| 5,298,891 | A | * | 3/1994 | Plus et al. | 345/93 |
| 5,337,173 | A | * | 8/1994 | Atsumi et al. | 359/54 |
| 5,394,368 | A | | 2/1995 | Miyamoto | 365/200 |
| 5,581,273 | A | * | 12/1996 | Yoneda et al. | 345/90 |
| 5,621,555 | A | | 4/1997 | Park | 349/54 |
| 5,712,652 | A | * | 1/1998 | Sato et al. | 345/90 |
| 5,748,165 | A | * | 5/1998 | Kubota et al. | 345/96 |
| 5,926,156 | A | * | 7/1999 | Katoh et al. | 345/100 |
| 5,945,972 | A | * | 8/1999 | Okumura et al. | 345/98 |

* cited by examiner

*Primary Examiner*—Bipin Shalwala
*Assistant Examiner*—Jimmy H. Nguyen
(74) *Attorney, Agent, or Firm*—Henneman & Saunders; Larry E. Henneman, Jr.

(57) ABSTRACT

A flat panel display includes a plurality of pixel cells arranged in a rectangular matrix of columns and rows. Each pixel cell includes a pixel electrode, a primary storage element, and a switch for selectively coupling the pixel electrode with the primary storage element and a storage element of another pixel cell in an adjacent row or column. Columns and/or rows of redundant storage elements are provided, such that the switches of pixel cells in the last row or column of the display selectively couple the pixel electrode with a primary storage element and a redundant storage element.

40 Claims, 12 Drawing Sheets

REPLACING DEFECTIVE CIRCUIT ELEMENTS BY COLUMN AND ROW SHIFTING IN A FLAT-PANEL DISPLAY

BACKGROUND OF THE INVENTION

1. Field of the Invention

This invention relates generally to flat panel displays, and more particularly to flat-panel displays having redundant elements to replace defective circuit elements.

2. Description of the Background Art

As shown in FIG. 1, a typical flat-panel display (e.g., a liquid crystal display for use with a computer) 100 includes a number of pixel cells 110(r,c) arranged in a rectangular array of m rows and n columns, a data bus driver 112 which asserts data signals on data lines 114(c), and an address bus driver 116, which sequentially asserts row-select signals on address lines 118(r). Each pixel cell 110 includes a capacitor 120, a transistor 122, and a pixel electrode 124. Transistor 122 has a gate terminal 126 coupled to address line 118(1), a drain terminal 128 coupled to data line 114(1), and a source terminal 130 coupled to capacitor 120. When address bus driver 116 asserts a high signal on address line 118(1), transistor 122 is turned on, allowing capacitor 120 to be charged or discharged, depending on the signal on data line 114(1), thus storing the data signal. Capacitor 120 is coupled to pixel electrode 124, and asserts the stored signal thereon. Pixel electrode 124 contacts an optically active pixel element (not shown), for example a liquid crystal cell, and the signal applied to the pixel electrode modulates the amount of light passing through the active pixel element.

Flat panel display 100 may be a reflective display or a transmissive display. In the case of a transmissive display, incident light passes through the optically active pixel element, the pixel electrode 124, and the substrate upon which the display is formed. Therefore, in transmissive displays, the electronic elements such as transistor 122 and capacitor 120 must be formed in gaps between the pixel electrodes 124(r,c), so as not to interfere with the light passing through the display. In a reflective display, light is reflected off the pixel electrode, and does not pass through the substrate. Therefore, in a reflective display, the electronic elements may be formed below the pixel electrode. In either case, broken data or address lines or defective electronic components can render one or more of the pixel cells inoperative, thus degrading the image generated by the display.

Because the display output is viewed as a complete image, corrective techniques typically employed in semiconductor memory devices to cope with defective array elements, e.g., the physical relocation of a row or column, are unsuitable for flat panel displays. Many attempts have been made to overcome the problem of defective elements in flat panel displays, but none have been completely successful. For example, U.S. Pat. No. 4,995,703, issued to Kesao Noguchi, describes the division of a single pixel into four separate pixels, each with its own pixel electrode and switching transistor. If a defect renders, for example, two of the four pixels inoperative, the remaining pixels may continue to function, rendering the defect less objectionable. However, this approach suffers from the disadvantage that twice as many data and address lines are required. More importantly, the four separate pixels must be separated by a finite gap, thus reducing the active pixel surface area, and causing a reduction in brightness.

Another technique is described in U.S. Pat. No. 4,680,580, issued to Yukito Kawahara. Kawahara describes a display wherein pixels whose scan or signal lines are broken are serviced by the scan or signal line of a neighboring pixel. While this technique yields a defect that is less objectionable than a row or column that is stuck on or off, it fails to completely compensate for a defective row or column, because the defective row or column is written with data intended for the neighboring row or column, and the original data intended for the defective row or column is lost.

What is needed is a display capable of replacing a defective row or column (e.g., broken row select lines, broken data lines, or defective circuit elements), while insuring that all pixels in the array, including the pixels of the defective rows or columns, are written with their intended data.

SUMMARY

A novel display, capable of replacing defective elements, for example broken row select lines, broken data lines, or defective circuit elements, by column and/or row shifting is described. The display generally includes a plurality of pixel cells, each having a pixel electrode in contact with an optically active element (e.g., a liquid crystal element), a primary storage element, and a switch for selectively coupling the pixel electrode with the primary storage element and at least one other storage element. The display may be either transmissive or reflective. In the case of a reflective display, the pixel electrodes are, for example, metallic mirrors, deposited over the switches and storage elements formed on a silicon substrate. The present invention recognizes that redundancy can be provided in the circuit elements, apart from the pixel electrodes and the optically active elements, such that replacement circuit elements can service a pixel electrode in its original position. Thus, no redundancy is necessary for the pixel electrodes or the optically active elements.

In one embodiment the display replaces defective elements by column shifting. A switch, for example a single bit multiplexer, selectively couples a pixel electrode with a primary storage element, for example an SRAM latch, and a storage element of an adjacent column. This embodiment further includes a controller, having a first voltage supply terminal, a second voltage supply terminal, a fuse, and a terminator. The fuse has a first end coupled to the first voltage supply and a second end coupled, via a control line, to the switch. The terminator is intercoupled between the second end of the fuse and the second voltage supply terminal, and operates to maintain a low voltage on the control line when the fuse is opened. Responsive to the low signal on the control line, the switch couples the pixel electrode with the storage element of the adjacent column. A data router, coupled to the control line, redirects data from the primary storage element to the adjacent storage element, responsive to the low signal on the control line.

Typically, any defective elements are identified and replaced during manufacturing. For instance, after the display has been fabricated, but before the display itself is completed, test data is conventionally written to and read from the storage elements of the display. Defects are identified by comparing the written to the read data. This information is then transferred to a computer controlled laser, which vaporizes the appropriate fuses, which are typically made of polysilicon or metal, of the controller, initiating the column shift. Optionally, the replacement of defective elements can occur in the field, by providing, for example, a software programmable controller. Of course other types of programmable elements can be substituted for the fuses.

In a second embodiment, the display replaces defective elements by row shifting. This embodiment includes a pixel electrode, a primary storage element, a second storage element, and a switch. The switch selectively couples the pixel electrode with the primary storage element and the second storage element, disposed in an adjacent row. This embodiment further includes a controller, coupled to the switch via a control line, for initiating a row shift. A row-select router, coupled to the control line, redirects row-select signals from the primary storage element to the second storage element.

In a third embodiment, the display replaces defective elements by column and row shifting. This embodiment includes a pixel electrode, a first switch, for example a two-bit multiplexer, a second switch, for example a two-level multiplexer, a primary storage element, a second storage element, a third storage element, and a fourth storage element. The first switch selectively couples the pixel electrode with the primary storage element, the second storage element disposed in an adjacent column, and the second switch. The second switch selectively couples the first switch with the third and fourth storage elements, disposed in an adjacent row, such that the pixel electrode may be coupled with either the third or fourth storage element, via the first and second switches. This embodiment further includes a column controller coupled to the switches via column control lines, a row controller coupled to the switches via row control lines, a data router coupled to the column control lines, and a row-select router coupled to the row control lines.

Finally, in a fourth embodiment, the display includes a pixel electrode, a first storage element, a second storage element, a first switch, and a second switch. The first switch selectively couples the pixel electrode with the first storage element, and the second switch selectively couples the pixel electrode with the second storage element. Optionally, the switches are CMOS transmission gates, each having a pair of control terminals. This embodiment further includes an activator and a controller. The activator is coupled to the controller and, via a pair of control lines, to the control terminals of the switches. Responsive to a signal from the controller, the activator asserts complimentary (inverse) signals on the pair of control lines. The switches are connected to the control lines in a complimentary fashion, such that both switches are neither on nor off at the same time.

DETAILED DESCRIPTION

The following detailed description describes a novel flat panel display. Numerous specific details are set forth, for example the number of pixels in the display, the type of storage elements employed, and the number of redundant storage elements provided. Those skilled in the art will recognize, however, that the invention may be practiced apart from these specific details. In other instances, details of well known circuits and techniques have been omitted so as not to obscure the present invention.

Figure 2:
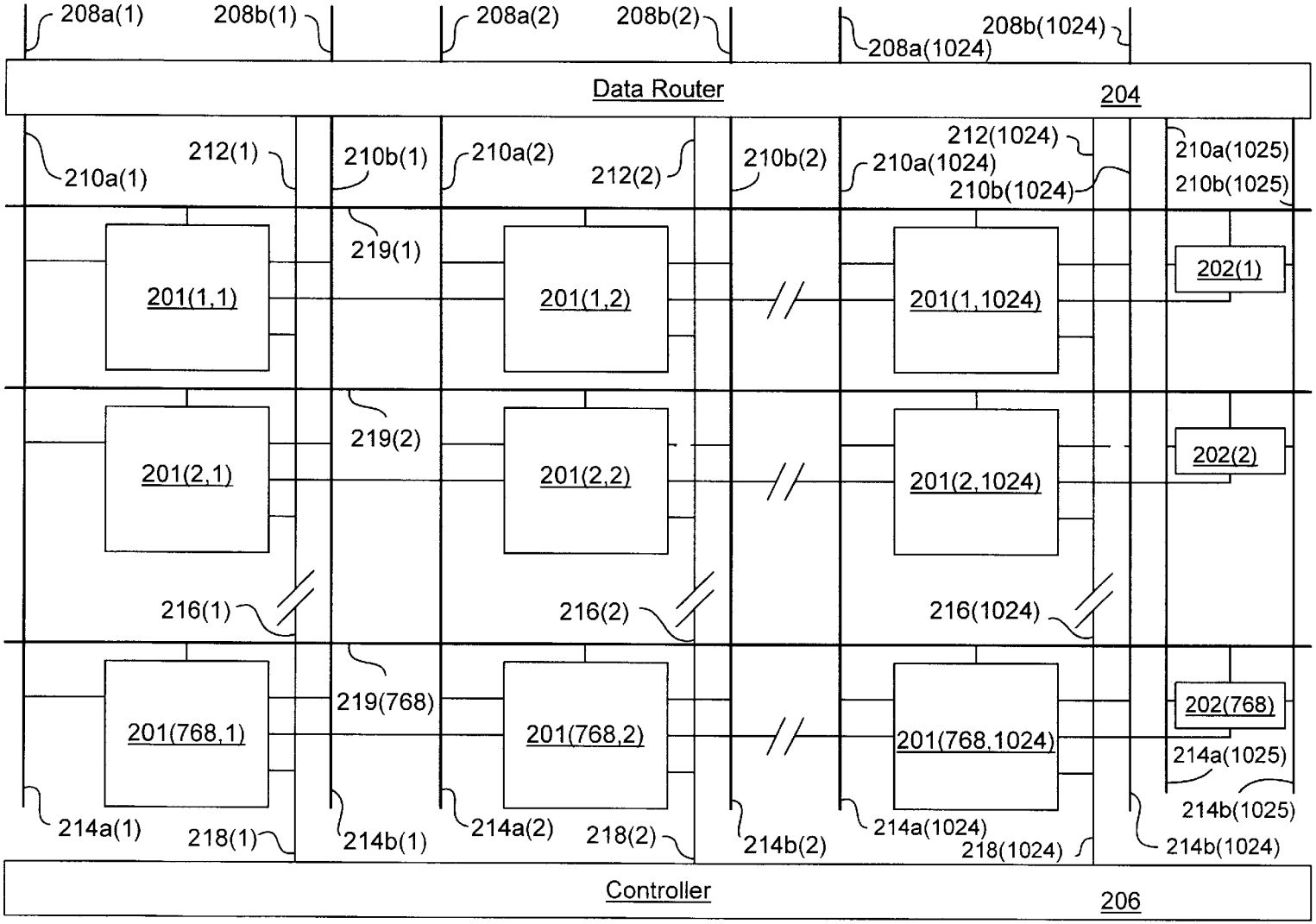
FIG. 2 is a block diagram of a flat panel display in accordance with a first embodiment of the present invention.

FIG. 2 shows a flat panel display 200, capable of defect compensation by column shifting, including a plurality of pixel cells 201(r,c), arranged in a rectangular matrix of rows and columns, where the indices r and c represent the row and column numbers of each pixel cells 201(r,c), respectively. Display 200 is shown, in this example, to include 768 rows and 1024 columns as in a typical computer display, but those skilled in the art will recognize that the invention may be practiced with more or fewer rows or columns. Display 200 further includes a plurality of redundant storage elements 202(r), a data router 204, and a controller 206.

Router 204 includes a plurality of data input terminals 208, a plurality of data output terminals 210, and a plurality of control input terminals 212. Data input terminals 208 are arranged in complementary pairs 208*a*(c) and 208*b*(c) to receive complementary data destined for a particular column of pixel cells 201(1,c)–201(768,c). For example, the pair of data input terminals 208*a*(1) and 208*b*(1) receive data that is to be displayed by pixel cells 201(r,1) of the first column. Data output terminals 21( ) are also arranged in pairs 210*a*(c) and 210*b*(c), each pair being coupled via pairs of data lines 214*a*(c) and 214*b*(c), respectively, with a column of pixel cells 201(1c)–201(768,c), except for data output terminals 210*a*(1025) and 210*b*(1025), which are coupled with the column of redundant storage elements 202(1)–202(768). Each control input terminal 212(c) is also coupled, via control lines 216(c), with a column of pixel cells 201(1,c)–201(768,c). Controller 206 includes a plurality of control output terminals 218(c), each coupled, via control line 216(c), to a respective control input terminal 212(c) of router 204. Finally, pixel cells 201(r,c) of common rows are coupled via row-select lines 219(r) to a row scanner (not shown).

Figure 2A:
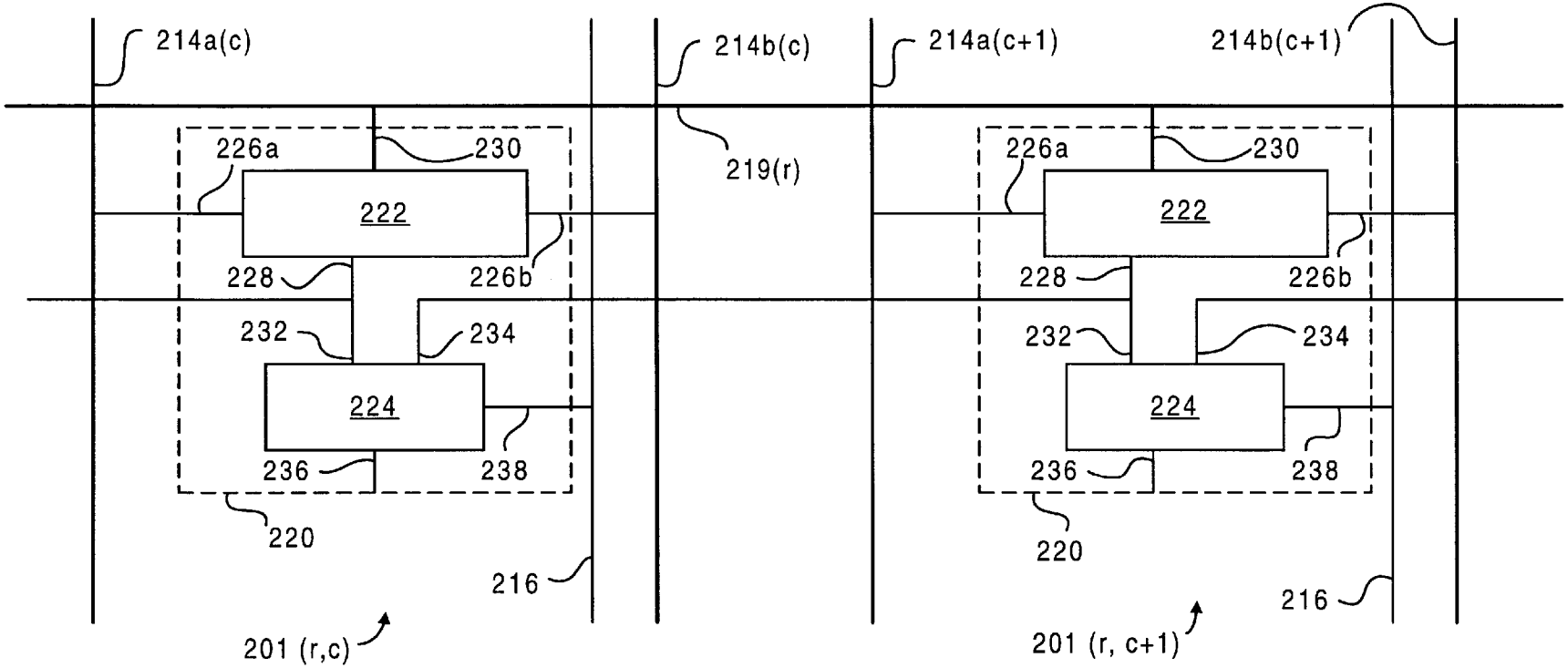
FIG. 2*a* is a detailed block diagram showing two adjacent pixel cells of the display shown in FIG. 2.

FIG. 2*a*, shows two adjacent pixel cells 201(r,c) and 201(r,c+1), each including a pixel electrode 220, a primary storage element 222, and a switch 224. Each pixel electrode 220 contacts an optically active pixel element (not shown), for example a liquid crystal cell. In a reflective display, pixel electrodes 220(r, c) are, for example, metallic mirrors. Each of storage elements 222(r,c) and 202(r) (FIG. 2) includes a pair of data input terminals 226*a*(r,c) and 226*b*(r,c), a data output terminal 228(r,c), and a row-select terminal 230(r,c). Complementary data input terminals 226*a*(r,c) and 226*b*(r,c) are coupled to data lines 214*a*(c) and 214*b*(c), respectively, and row-select terminal 230(r,c) is coupled to row-select line 219(r). Responsive to a row-select signal being asserted on row-select line 219*r*, storage element 222(r,c) stores the data being asserted on data lines 214*a*(c) and 214*b*(c), and then asserts the stored data on data output terminal 228(r,c), until it is rewritten with new data.

Each switch 224(r,c) includes a first input terminal 232 (r,c), a second input terminal 234(r,c), an output terminal 236(r,c), and a control terminal 238(r,c). First input terminal 232(r,c) is coupled to output terminal 228(r,c) of storage element 222(r,c), second input terminal 234(r,c) is coupled to output terminal 232(r,c+1) of adjacent storage element 222(r,c+1), and output terminal 236(r,c) is coupled to pixel electrode 220(r,c). Control terminal 238(r,c) is coupled to control line 216(c).

Display 200 replaces defective elements as follows. Assume that a column (x) has a defect, for example a shorted storage element 222(r,x). In order to replace the defective column (x), controller 206 asserts a first control signal on all control lines 216(c) to the left of the defective column (x), i.e., all control lines 216(c) where c<x, and a second control signal on the remaining control lines 216(c), where c≧x. For all columns where c<x, the first control signal on control lines 216(c)c causes all switches 224(r,c) to couple the output terminals 228(r,c) of storage elements 222(r,c) with pixel electrodes 220(r,c), such that data stored in storage elements 222(r,c) is asserted on pixel electrodes 220(r,c). For all columns where c≧x, the second control signal on control lines 216(c) causes all switches 224(r,c) to couple the output terminals 228(r,c+1) of adjacent storage elements 222(r,c+1) (or storage elements 202(r) in the case of the last column) with pixel electrodes 220(r,c), such that data stored in adjacent storage elements 222(r,c+1) (or storage elements 202(r)) is asserted on pixel electrodes 220(r,c). Thus, each switch 224(r,c) selectively couples pixel electrode 220(r,c) with either storage element 222(r,c) or an adjacent storage element 222(r,c+1) (or 202(r)).

In order that each pixel electrode 220(r,c) is driven with its intended data, router 206 responds to the control signals on control lines 216(c), as follows. Responsive to the first control signal being asserted on a given control line 216(c), router 204 directs the data received on data input terminals 208*a*(c) and 208*b*(c) to data output terminals 210*a*(c) and 210*b*(c), and thus to data lines 214*a*(c) and 214*b*(c), respectively. Responsive to the second control signal being asserted on a given control line 216(c), router 204 redirects the data received on data input terminals 208*a*(c) and 208*b*(c) to data output terminals 210*a*(c+1) and 210*b*(c+1), and thus to data lines 214*a*(c+1) and 214*b*(c+1), respectively. The routing function performed by router 204, in cooperation with the selective coupling function of switches 224(r,c), insures that all data is written to its intended pixel electrode 220(r,c).

While display 200 is shown, for clarity, to include only one column of redundant storage elements, those skilled in the art will understand that additional columns of redundant storage elements may be included to replace additional defective display columns. For example, by substituting a two-bit multiplexer for switches 224(r,c) and adding a second control line for each column, each pixel electrode 220(r,c) could be selectively coupled to four, rather than two, different storage elements 222(r,c).

Furthermore, display 200 is shown in FIG. 2 with pixel electrodes 220(r,c) overlaying the electrical components such as storage elements 222(r,c) and switches 224(r,c). Such an arrangement is indicative of a reflective display, wherein the electrical components are formed on a silicon substrate, and the pixel electrodes are reflective, metallic mirrors formed over the electrical components. Those skilled in the art will recognize, however, that the present invention is not limited to reflective displays, and may be practiced in transmissive displays, for example displays formed by thin film transistors (TFTs) on glass. In such TFT displays, the electronics are formed in gaps between the pixel electrodes, so as not to interfere with the light passing through the display.

Figure 3:
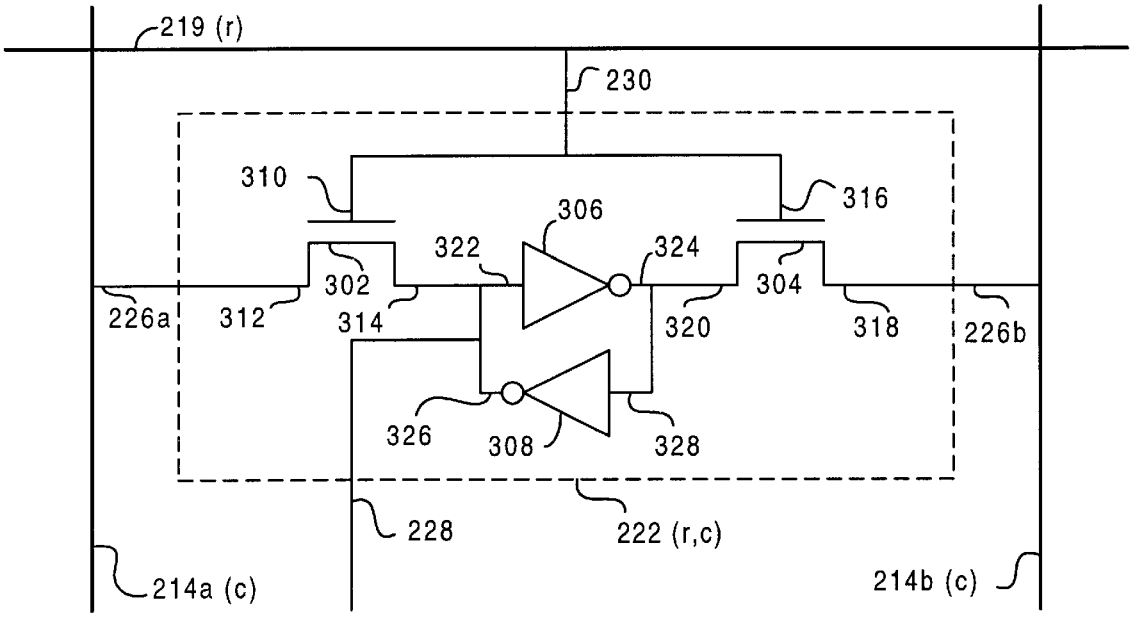
FIG. 3 is a schematic diagram of a storage element shown in a pixel cell of FIG. 2*a;*

FIG. 3 shows one of the storage elements 222(r,c), of display 200, in greater detail. Storage element 222(r,c) includes a first NMOS transistor 302, a second NMOS transistor 304, a first inverter 306, and a second inverter 308. First NMOS transistor 302 has a gate terminal 310 coupled to row-select terminal 230, a drain terminal 312 coupled to first data input terminal 226*a*, and a source terminal 314 coupled to data output terminal 228. Second NMOS transistor 304 has a gate terminal 316 coupled to row-select terminal 230, a source terminal 318 coupled to second data input terminal 226*b*, and a source terminal 320. Inverter 306 has an input terminal 322, coupled to data output terminal 228, and an output terminal 324 coupled to source terminal 320 of second NMOS transistor 304. Inverter 308 has an output terminal 326, coupled to data output terminal 228, and an input terminal 328 coupled to source terminal 320 of second NMOS transistor 304.

When a high signal, is asserted on row-select terminal 230, and thus coupled gate terminals 310 and 316 of first NMOS transistor 302 and second NMOS transistor 304 respectively, first and second NMOS transistors 302 and 304 are brought into a conducting state. Depending on the data signals being asserted on data input terminals 226*a* and 226*b*, via data lines 210*a*(c) and 210*b*(c), data output terminal 228 is pulled into either a high or a low state. If, for example, a high signal is being asserted on data input terminal 226*a* and a low signal is being asserted on data input terminal 226*b*, then data output terminal 228 is pulled into a high state as follows. The high signal on data input terminal 226*a* is communicated through conducting first NMOS transistor 302, to the input terminal 322 of first inverter 306 and to data output terminal 228. Responsive to the high signal on its input terminal 322, first inverter 306 asserts, via output terminal 324, a low signal on the input terminal 328 of second inverter 308, causing second inverter 308 to assert a high signal, via its output terminal 326, on data output terminal 228(r,c). Because the high signal asserted by second inverter 308 is also asserted on the input terminal 322 of first inverter 306, the high signal is latched on data output terminal 228(r,c), even after first and second NMOS transistors 302 and 304 are no longer in a conducting state.

The latched state of storage element 222(r,c) can be changed as follows. First, a low signal is asserted on data input terminal 226*a* and a high signal is asserted on data input terminal 226*b*. Then, when NMOS transistors 302 and 304 are brought into a conducting state by a row-select signal, the low signal on data input terminal 226*a* is asserted, through conducting NMOS transistor 302, onto data output terminal 228 and input terminal 322 of first inverter 306. The high signal on data input terminal 226*b* is asserted, through conducting NMOS transistor 304, onto the input terminal 328 of inverter 308, to prevent inverter 308 from attempting to maintain the high signal on data output terminal 228. Additionally, responsive to the low signal being asserted on its input terminal 322, first inverter 306 asserts a high signal on the input terminal 328 of second inverter 308, causing inverter 308 to latch the low signal on data output terminal 228, even after first and second NMOS transistors 302 and 304 are no longer in a conducting state.

Figure 1:
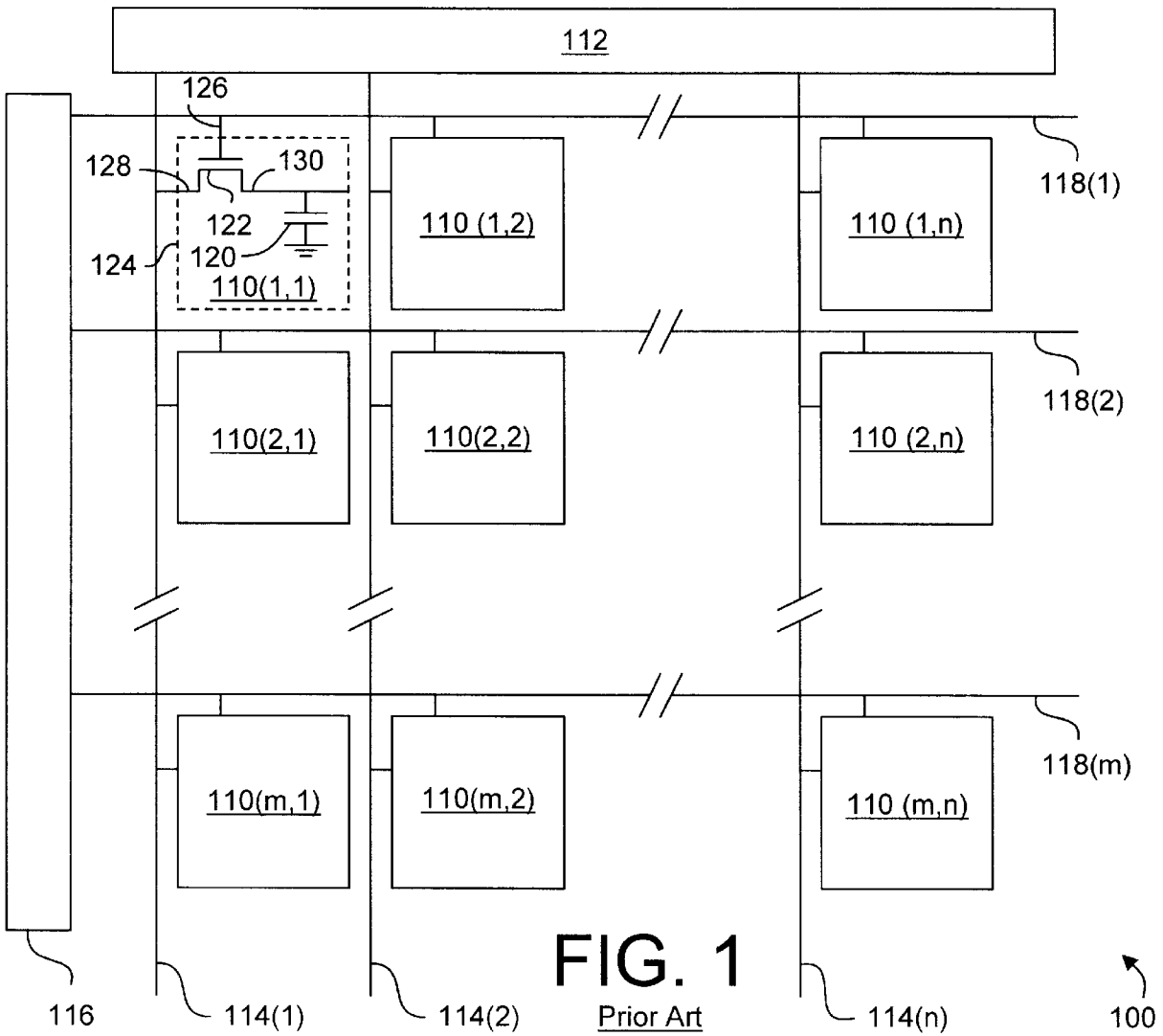
FIG. 1 Prior Art
FIG. 1 illustrates a prior art flat panel display.

Those skilled in the art will recognize storage element 222(r,c) as a static random access memory (SRAM) latch. It should be apparent, however, that the present invention may be practiced with other types of storage elements, including, but not limited to, dynamic random access memory (DRAM) latches. Furthermore, while the particular embodiment described employs a digital storage element, those skilled in the art will understand that the present invention may be practiced using analog type storage elements having a single data input terminal as shown, for example, in FIG. 1.

Figure 4:
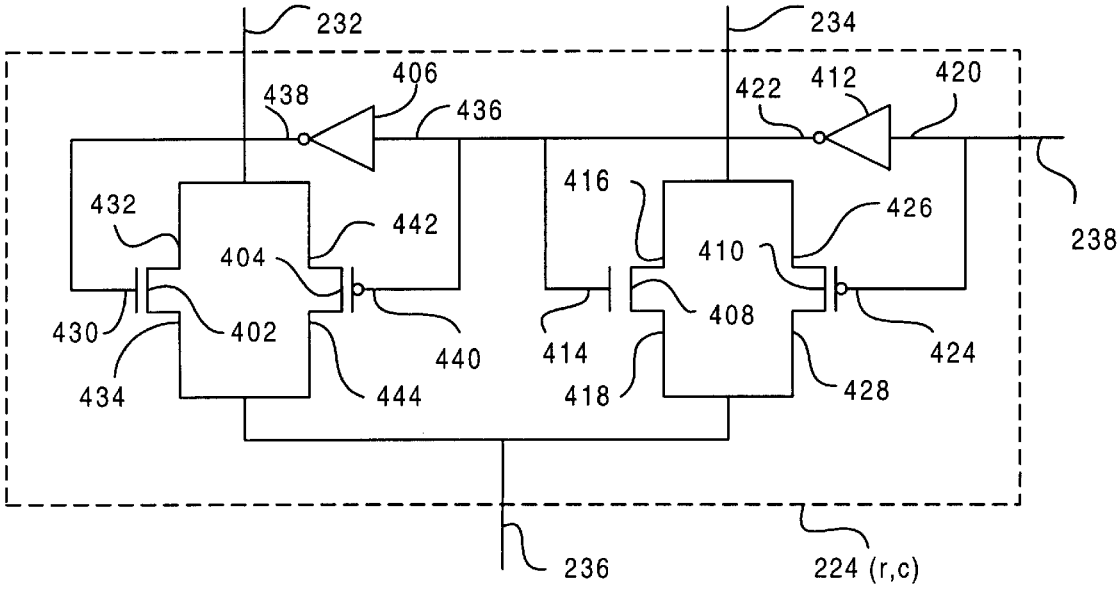
FIG. 4 is a schematic diagram of a switch shown in a pixel cell of FIG. 2*a;*

FIG. 4 shows a detailed view of one of the switches 224(r,c), of pixel cell 201 (r,c). Switch 224(r,c) includes a first NMOS transistor 402, a first PMOS transistor 404, a first inverter 406, a second NMOS transistor 408, a second PMOS transistor 410, and a second inverter 412. Second PMOS transistor 410 has a gate terminal 424 coupled to control terminal 238, a source terminal 426 coupled to second input terminal 234 and a drain terminal 428 coupled to output terminal 236. Second inverter 412 has an input terminal 420, coupled to control terminal 238, and an output terminal 422. Second NMOS transistor 408 has a gate terminal 414 coupled to output terminal 422 of second inverter 412, a drain terminal 416 coupled to second input terminal 234, and a source terminal 418 coupled to output terminal 236. First PMOS transistor 404 has a gate terminal 440 coupled to output terminal 422 of second inverter 412, a source terminal 442 coupled to first input terminal 232, and a drain terminal 444 coupled to output terminal 236. First inverter 406 has an input terminal 436 coupled to output terminal 422 of second inverter 412, and an output terminal 438. First NMOS transistor 402 has a gate terminal 430 coupled to output terminal 438 of first inverter 406, a drain terminal 432 coupled to first input terminal 232(r,c), and a source terminal 434 coupled to output terminal 236(r,c).

Those skilled in the art will recognize that second NMOS transistor 408, second PMOS transistor 410, and second inverter 412, connected as described, operate as a conventional transmission gate. A low signal on control terminal 238 turns second PMOS transistor 410 on, and causes second inverter 412 to assert a high signal on gate terminal 414 of second NMOS transistor 408, turning it on as well. Thus, when a low signal is asserted on control terminal 238, a signal on second input terminal 234 is communicated to output terminal 236. When, however, a high signal is asserted on control terminal 238, second NMOS transistor 408 and second PMOS transistor 410 are turned off, effectively isolating output terminal 236 from second input terminal 234. The combination of second NMOS transistor 408 and second PMOS transistor 410 insures that output terminal 236 can follow the voltage on second input terminal 234 all the way to either of the high or low supply voltages.

First NMOS transistor 402, first PMOS transistor 404, and first inverter 406 also function together as a transmission gate. However, because the gate terminal 440 of first PMOS transistor 404 and the input terminal 436 of first inverter 406 are coupled to control terminal 238 through second inverter 412, the transmission gate formed by first NMOS transistor 402, first PMOS transistor 404, and first inverter 406 responds to the control signal on control terminal 238 in a complimentary fashion with respect to the transmission gate formed by second NMOS transistor 408, second PMOS transistor 410, and second inverter 412. Specifically, a low signal on control terminal 238 causes first NMOS transistor 402 and first PMOS transistor 404 to turn off, effectively isolating output terminal 236 from first input terminal 232. On the other hand, a high signal on control terminal 238 causes first NMOS transistor 402 and first PMOS transistor 404 to turn on, so that the voltage on output terminal 236 tracks the voltage on first input terminal 232.

As described, switch 224(r,c) functions as a single-bit controlled (2 to 1) multiplexer. Responsive to a first (high) signal on control terminal 238, switch 224(r,c) passes the signal on first input terminal 232 to output terminal 236, and isolates second input terminal 234 from output terminal 236. Responsive to a second (low) signal on control terminal 238, switch 224(r,c) passes the signal on second input terminal 234 to output terminal 236, and isolates first input terminal 232 from output terminal 236. Thus, switch 224(r,c) selectively couples its first input terminal 232 and its second input terminal 234 with its output terminal 236.

Those skilled in the art will also recognize that one of inverters 406 or 412 could be eliminated from switch 224(r,c). For example, inverter 406 could be eliminated, by coupling gate terminal 430 of NMOS transistor 402 directly to control terminal 238, without changing the operation of switch 224(r,c). Obviously, such reduction in the number of devices is desirable.

Figure 5:
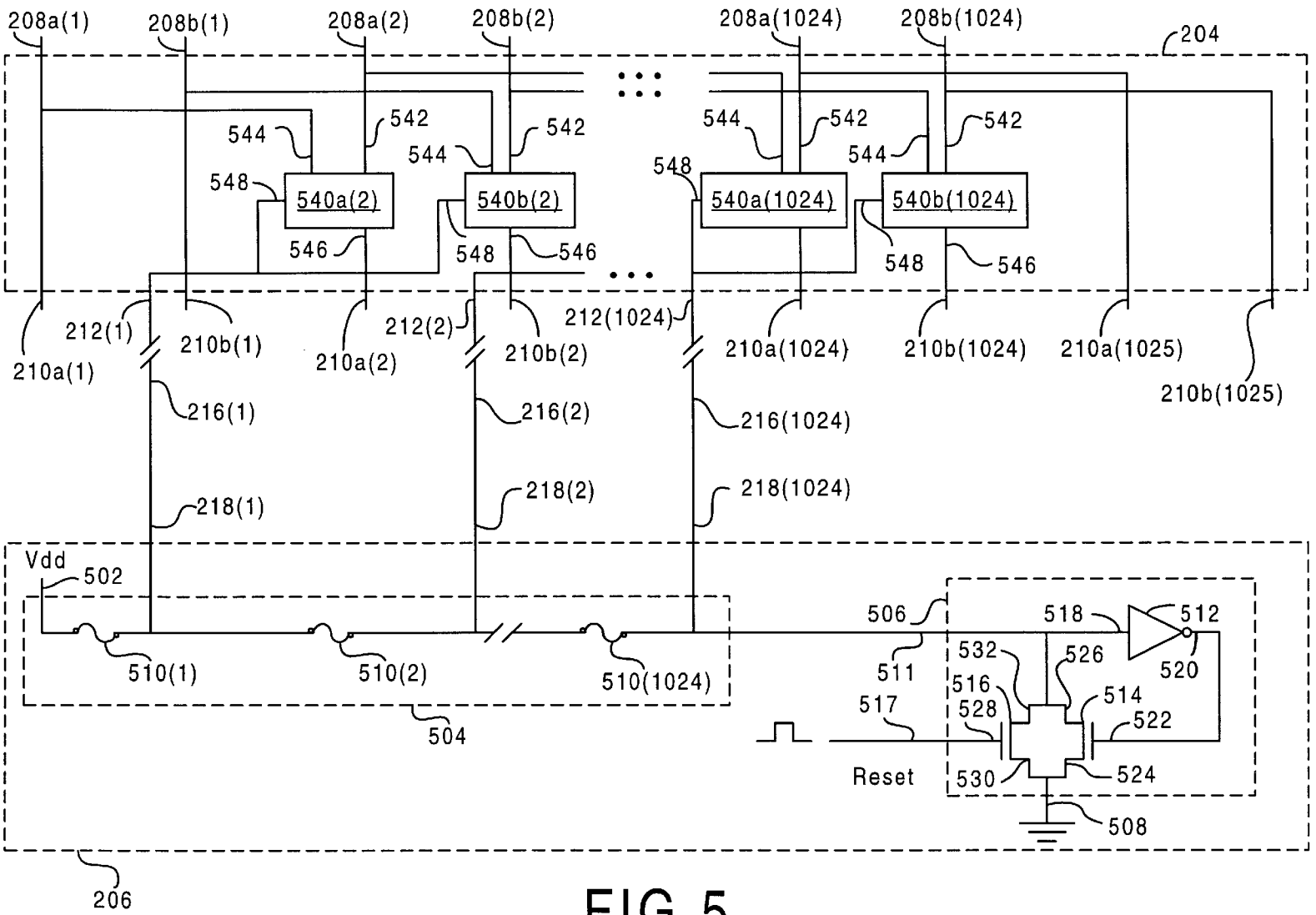
FIG. 5 is a schematic diagram of a router and a controller of the display shown in FIG. 2.

FIG. 5 shows router 204 and controller 206 in greater detail. The matrix of pixel cells 201(r,c) of display 200 is omitted for clarity. Controller 206 includes a first (Vdd) voltage supply terminal 502, a fuse chain 504, a terminator 506, and a second (gnd) voltage supply terminal 508.

Fuse chain 504 includes a plurality of fuses 510(c), coupled in series between first voltage supply terminal 502 and terminator 506. Fuses 510(c) are polysilicon fuses, which can be selectively vaporized by a laser (not shown). Those skilled in the art will understand, however, that fuses 510 may be formed from metal, or any other material capable of being selectively disrupted to open the circuit. Each control output terminal 218(c) is coupled to fuse chain 504 between fuses 510(c) and 510(c+1).

Terminator 506 includes an input terminal 511, an inverter 512, a first NMOS transistor 514, a second NMOS transistor 516, and a reset terminal 517. Input terminal 511 is coupled to first voltage supply terminal 502, via fuse chain 504. Inverter 512 has an input terminal 518, coupled to input terminal 511, and an output terminal 520. First NMOS transistor 514 has a gate terminal 522 coupled to output terminal 520 of inverter 512, a source terminal 524 coupled to second supply terminal 508, and a drain terminal 526 coupled to input terminal 511. Second NMOS transistor 516 has a gate terminal 528 coupled to reset terminal 517, a source terminal 530 coupled to second supply terminal 508, and a drain terminal 532 coupled to input terminal 511.

When there are no defective elements to be replaced in display 200, all fuses 510(c) are left intact, and the fuse chain 504 maintains each control output terminal 218(c) at Vdd. Responsive to the high (Vdd) signal on its input terminal 518, inverter 512 asserts a low signal on its output terminal 520, maintaining first NMOS transistor 514 in a nonconducting state. Similarly, reset terminal 517 is normally held low, maintaining second NMOS transistor 516 in a nonconducting state. Thus, when there are no defects in display 200, controller 206 asserts a first signal (Vdd) on all control lines 216(c), via control output terminals 218(c).

If, however, there is a defect in a column of display 200, for example column (x), then controller 206 is set as follows.

First, fuse 510(x), is selectively blown, disconnecting the portion of fuse chain 504 between the opened fuse 510(x) and terminator 506 from Vdd. Next, a high reset pulse is applied to reset terminal 517, placing second NMOS transistor 516 in a conducting state, thereby pulling input terminal 511 and coupled control output terminals 218(x)–218(1024) low (close to gnd). Because input terminal 518 of inverter 512 is also coupled to input terminal 511, the low signal on input terminal 511 causes inverter 512 to assert a high signal on its output terminal 520, placing first NMOS transistor 514 in a conducting state, thus maintaining the low signal on output terminal 511, even after the reset pulse ends.

In summary, when a column (x) has a defect, fuse 510(x) is selectively blown and a reset pulse is applied to reset terminal 517. Thereafter, controller 206 asserts a first (high) signal on control output terminals 218(1)–218(x−1), and asserts a second (low) signal on control output terminals 218(x)–218(1024). Those skilled in the art will recognize that any circuit, for example a register, that is capable of storing and asserting the appropriate signals on control lines 216(c) may be substituted for controller 206.

Defective elements are identified and replaced, while display 200 is still on the substrate from which it is manufactured. Test data is written to and read from storage elements 222(r,c), and defects are identified by comparing the written data to the read data. This information is then transferred to a computer controlled laser (not shown), which vaporizes the appropriate fuse 510(c) of controller 206, initiating the column shift. Optionally, the replacement of defective elements can occur in the field, by substituting, for example, a software programmable controller for controller 206.

In addition to controlling switches 224(r,c), as described above, the signals asserted on control output terminals 218(c) control the operation of router 204. Router 204 includes a plurality of pairs (a and b) of switches 540*a*(c) and 540*b*(c), each of which is substantially identical to switches 224(r,c). Switches 540*a*(c) and 540*b*(c) have first input terminals 542 coupled to data input terminals 208*a*(c) and 208*b*(c), second input terminals 544 coupled to data input terminals 208*a*(c−1) and 208*b*(c−1), output terminals 546 coupled to data output terminals 210*a*(c) and 210*b*(c), and control terminals 548 coupled, via control input terminal 212(c−1), to control line 216(c−1), respectively. For example, as shown in FIG. 5, switch 540*a*(2) has a first input terminal 542 coupled to data input terminal 208*a*(2), a second input terminal 544 coupled to data input terminal 208*a*(1), an output terminal 546 coupled to data output terminal 210*a*(2), and a control terminal 548 coupled, via control input terminal 212(1), to control line 216(1).

Each of switches 540*a*(c) and 540*b*(c) selectively couples one data output terminal 210*a*(c) and 210*b*(c) with two data input terminals 208*a*(c and c−1) and 208*b*(c and c−1). For example, responsive to controller 206 asserting a first (high) signal on control terminal 548, via control line 216(1) and control input terminal 212(1), switch 540*a*(2) couples data input terminal 208*a*(2) with data output terminal 210*a*(2). If, however, controller 206 asserts a second (low) signal on control terminal 548, then switch 540*a*(2) couples data input terminal 208*a*(1) with data output terminal 210*a*(2). The result of the selective coupling performed by switches 540*a*(c) and 540*b*(c) is that if controller 206 asserts a high signal on a given control line 216(c), then the data destined for column (c) is passed to the data lines 210*a*(c) and 210*b*(c) of column (c). On the other hand, if controller 206 asserts a low signal on control line 216(c), then the data originally destined for column (c) is redirected to column (c+1).

Note that no switches are interposed between the pair of data input terminals 208*a*(1) and 208*b*(1) and the pair of data output terminals 210*a*(1) and 210*b*(1), or between the pair of data input terminals 208*a*(1024) and 208*b*(1024) and the pair of data output terminals 210*a*(1025) and 210*b*(1025), respectively. This is because in this embodiment no data is routed from another column to column 1, or from column 1025 to another column. Those skilled in the art will understand, however, that switches could be employed to so route data if desired. Furthermore, such additional switches could be employed to provide isolation between data input terminals 208*a*(1024) and 208*b*(1024) and data output terminals 210*a*(1025) and 210*b*(1025), respectively, to prevent an electrical short in data lines 216*a*(1025) or 216*b*(1025) from rendering data input terminals 208*a*(1024) or 208*b* (1024) inoperative. Similarly, switches could be interposed between 208*a*(1) and 208*b*(1) and data output terminals 210*a*(1) and 210*b*(1), respectively.

Figure 6:
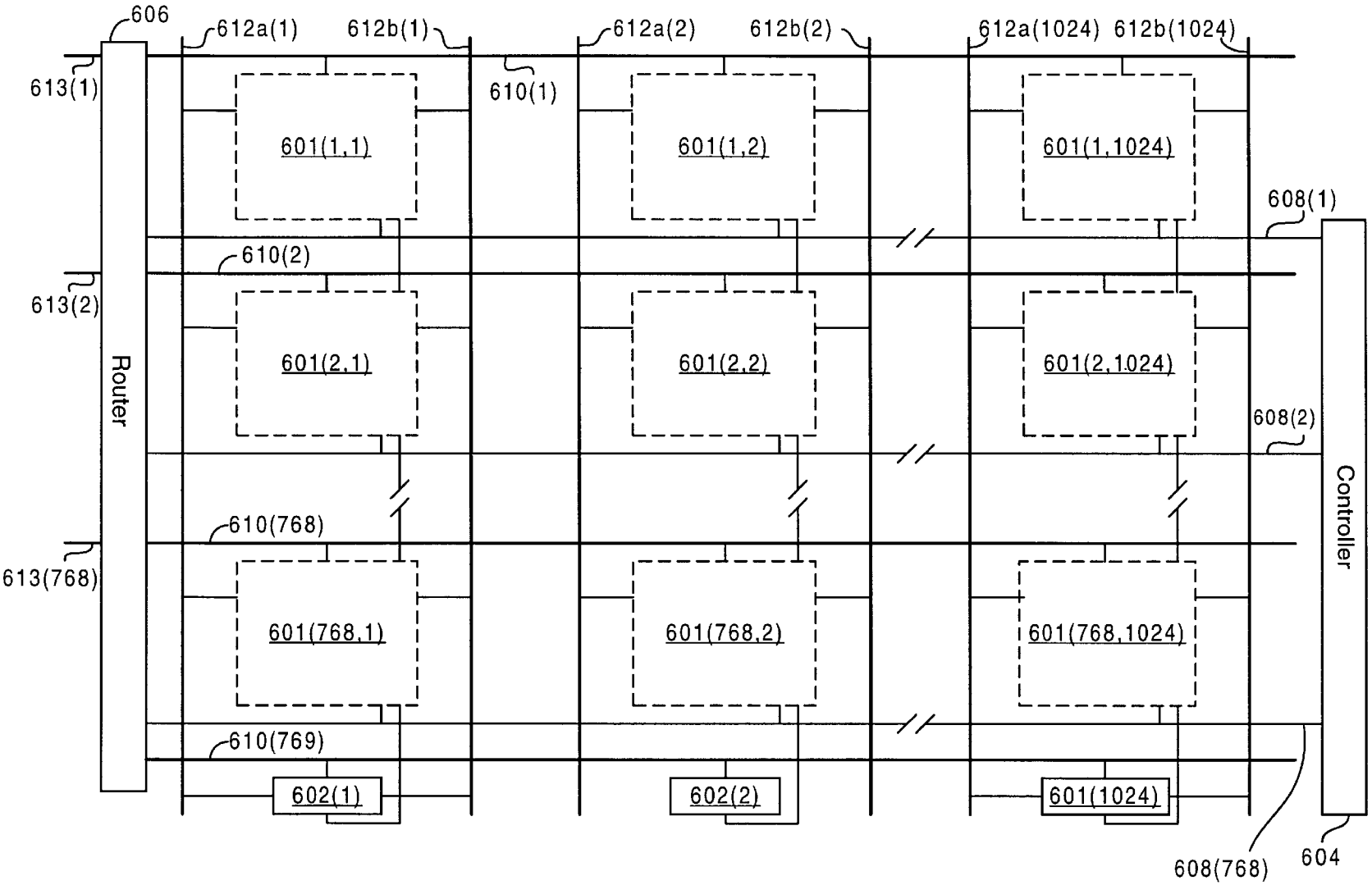
FIG. 6 is a block diagram of a flat panel display in accordance with a second embodiment of the present invention.

FIG. 6 shows an alternate display 600, capable of compensating for a defective element by row shifting in accordance with the present invention. Display 600 includes a plurality of pixel cells 601(r,c), arranged in a rectangular matrix, with the indices (r,c) indicating the respective row and column of each pixel cell 601(r,c). Display 600 further includes a plurality of redundant storage elements 602(c), arranged in a row adjacent the last row of pixel cells 601(768,c), a controller 604, and a row-select router 606.

Controller 604 is the same as controller 206, except that in display 600 controller 604 asserts control signals on a plurality of control lines 608(r), with each control line 608(r) being coupled to a single row of pixel cells 601(r,c). Row-select router 606 is similar to data router 204, except that row-select router 606 requires fewer switches and terminals because there is only one row-select line 610(r) for each row, as opposed to two data lines 612*a*(c) and 612*b*(c) for each column.

Row-select router 606 insures that pixel cells 601(r,c) are enabled to read data from data lines 612*a*(c) and 612*b*(c) at the appropriate time, by directing row-select signals asserted on its input terminals 613(r) to the appropriate row-select line 610(r) or 610(r+1). Specifically, responsive to a first (high) control signal being asserted on a given control line 608(r), row-select router 606 directs the row-select signals asserted on input terminal 613(r) to row-select line 610(r). Responsive to a second (low) control signal being asserted on a given control line 608(r), row-select router 606 redirects the row-select signals asserted on input terminal 613(r) to row-select line 610(r+1). Thus, row-select signals originally intended for a defective row are redirected to an adjacent row.

Figure 6A:
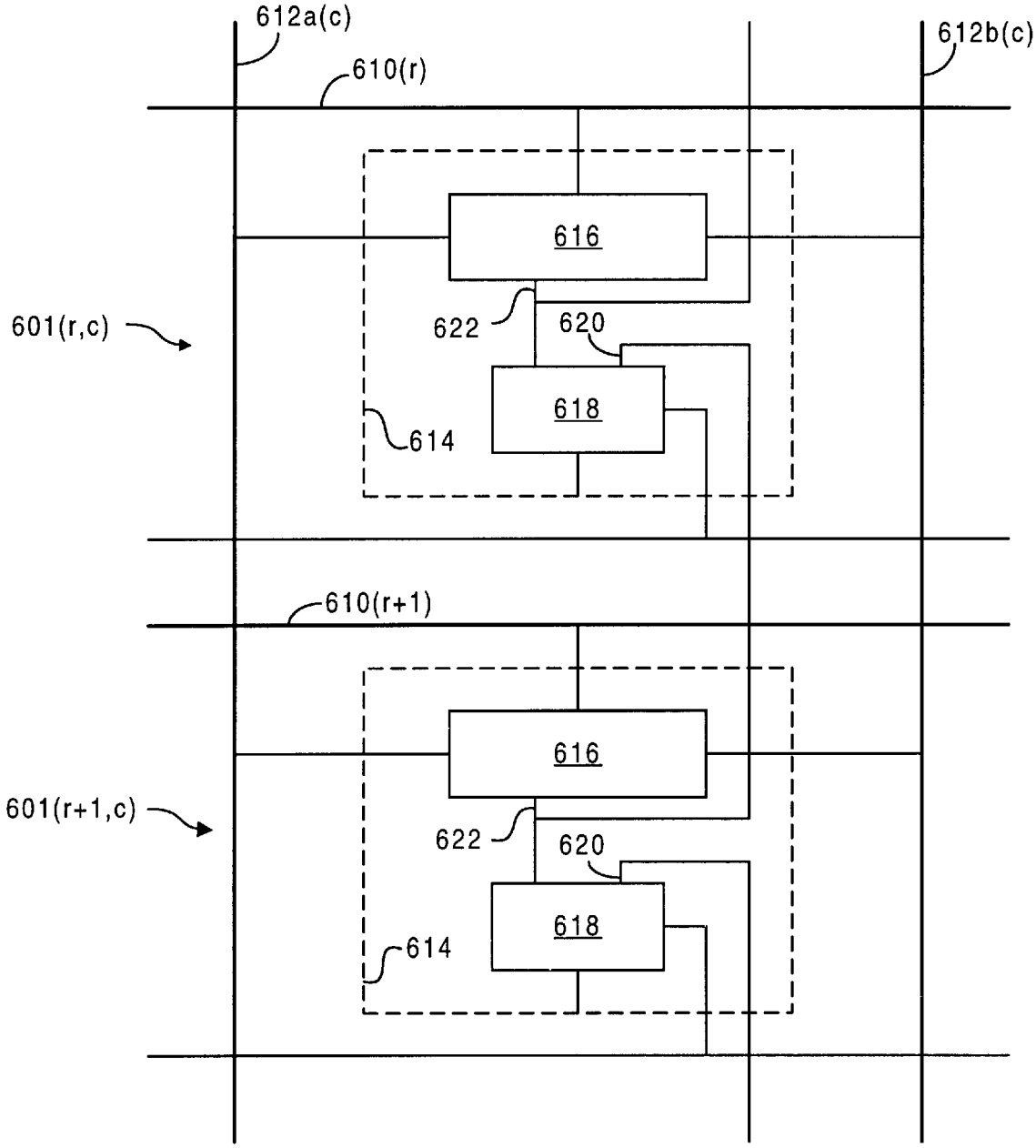
FIG. 6*a* is a detailed block diagram showing two adjacent pixel cells of the display shown in FIG. 6.

FIG. 6*a* shows two adjacent pixel cells 601(r,c) and 601(r+1,c), each including a pixel electrode 614, a primary storage element 616, and a switch 618. Pixel electrodes 614(r,c), primary storage elements 616(r,c), switches 618(r, c), and redundant storage elements 602(c) are the same as the like components of display 200. The difference in display 600 is that the second input terminal 620 of each switch 618(r,c) is coupled to the output terminal 622 of the storage element 616(r+1, c) of an adjacent row. In the case of the last row of switches 618(768,c), their second input terminals 638(768,c) are coupled to redundant storage elements 602(c).

Display 600 replaces a defective element in a given row (x) as follows. Controller 604 asserts a first (high) control signal on all control lines 608(r) above the defective row (x), i.e., all control lines 608(r) where r<x, and a second control signal (low) on the remaining control lines 608(r), where r≧x. For all rows where r<x, the first control signal on control lines 608(r) causes switches 618(r,c) to couple the output terminals 622 of storage elements 616(r,c) with pixel electrodes 614(r,c), such that data stored in storage elements 616(r,c) is asserted on pixel electrodes 614(r,c). For all rows where r≧x, the second control signal on control lines 608(r) causes switches 606(r,c) to couple the output terminals 622 of storage elements 616(r+1,c) (or storage elements 608(c) in the case of the last row) with pixel electrodes 614(r,c), such that data stored in adjacent storage elements 616(r+1,c) (or storage elements 602(c)) is asserted on pixel electrodes 614(r,c). Thus, each switch 618(r,c) selectively couples pixel electrode 614(r,c) with storage element 616(r,c) and an adjacent storage element 616(r+1,c) (or 602(c)).

Figure 7:
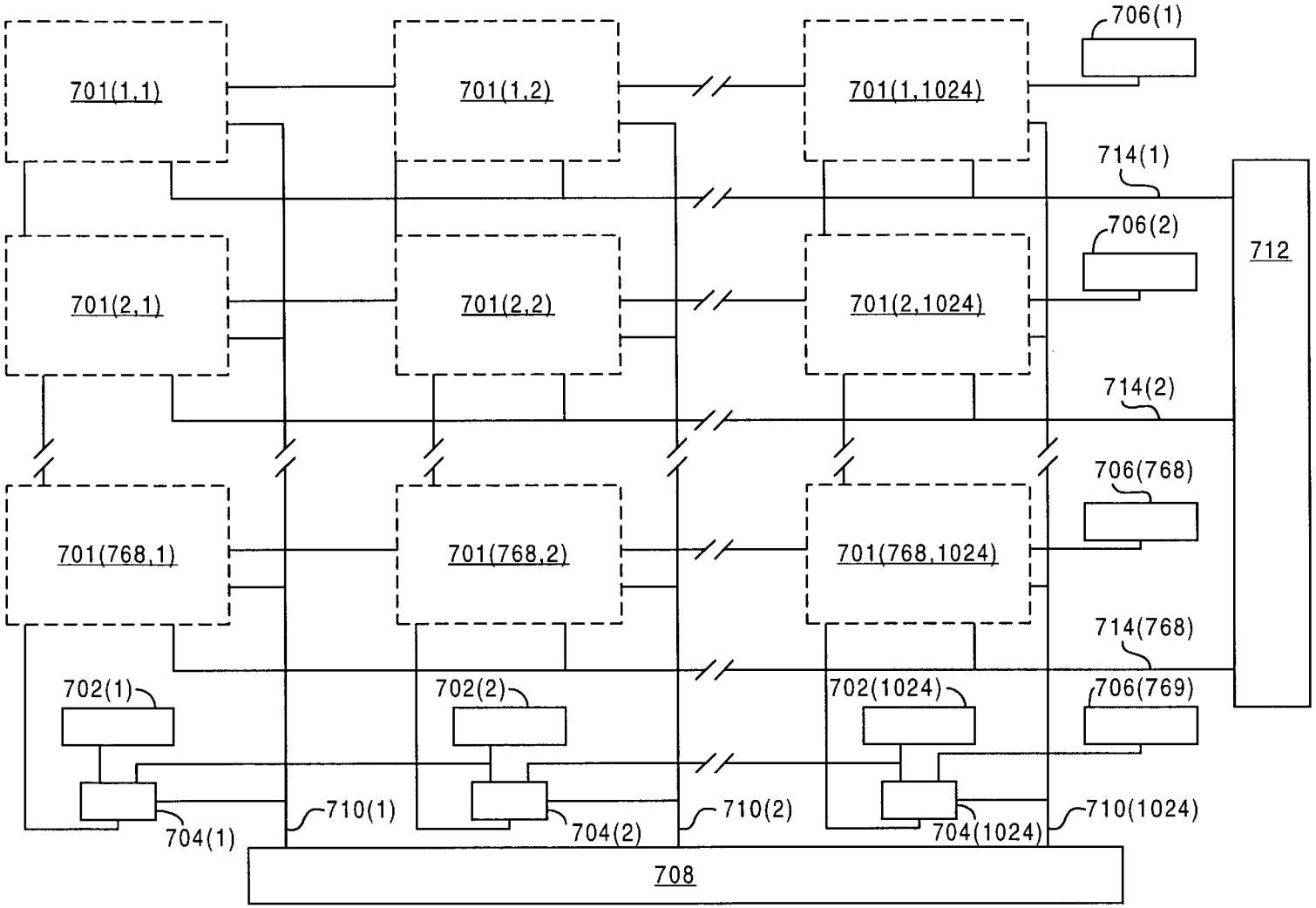
FIG. 7 is a block diagram of a flat panel display in accordance with a third embodiment of the present invention, wherein data and row-select lines are omitted for clarity.

FIG. 7 shows an alternate display 700, combining the column shifting of display 200 with the row shifting of display 600. Display 700 includes a plurality of pixel cells 701(r,c), a row of redundant storage elements 702(c), a row of redundant switches 704(c), a column of redundant storage elements 706(r), a column controller 708, a plurality of column control lines 710(c), a row controller 712, and a plurality of row control lines 714(r). The indices (r) and (c) represent the row and column, respectively, in which a given device is located. Redundant storage elements 702(c) and 706(r), redundant switches 704(c), column controller 708 and row controller 712 function the same as the analogous components of displays 200 and 600. Display 700 also includes a data router, a row-select router, data lines, and row-select lines, each of which function substantially the same as the analogous elements of displays 200 and 600, but these elements are omitted from FIG. 7 for clarity.

Figure 7A:
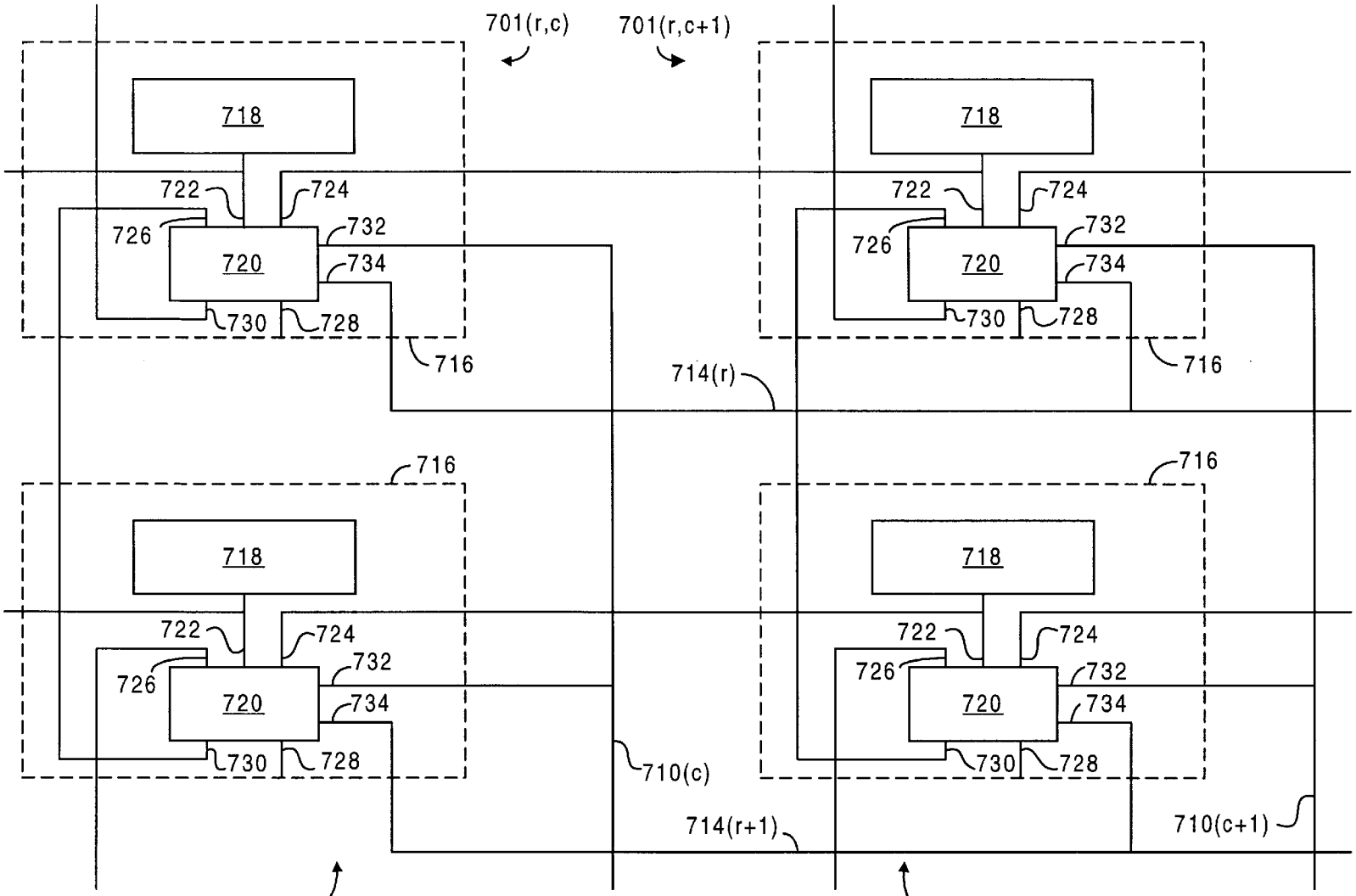
FIG. 7*a* is a detailed block diagram showing four adjacent pixel cells of the display shown in FIG. 7.

FIG. 7*a* shows four adjacent pixel cells 701(r,c), 701(r+1,c), 701(r,c+1), and 701 (r+1,c+1), each including a pixel electrode 716, a primary storage element 718, and a primary switch 720. Pixel electrodes 716 and primary storage elements 718 are the same as the like components of display 200. Primary switches 720, however, are more complex.

Each primary switch 720 has a first input terminal 722, a second input terminal 724, a third input terminal 726, a first output terminal 728, a second output terminal 730, a column control terminal 732, and a row control terminal 734. The terminals of a given primary switch 720(r,c) are coupled as follows. First input terminal 722 is coupled to primary storage element 718(r,c), second input terminal 724 is coupled to primary storage element 718(r,c+1), and third input terminal 722 is coupled to second output terminal 730 of switch 720(r+1,c). First output terminal 728 is coupled to pixel electrode 716(r,c), and second output terminal 730 is coupled to third input terminal 726 of primary switch 720(r−1,c) (not shown). Column control terminal 732 is coupled to column control line 710(c), and row control terminal 734 is coupled to row control line 714(r).

There are some exceptions to the above described coupling of primary switches 720(r,c). For example, second output terminals 730 of primary switches 720(1,c) (first row) are unused, because there are no storage elements disposed above the first row. Those skilled in the art will recognize that single output switches could be substituted for primary switches 720(1,c). Also, second input terminals 724 of primary switches 720(r,1024) (last column) are coupled to redundant storage elements 706(r), and third input terminals of primary switches 720(768,c) (last row) are coupled to redundant switches 704(c).

Display 700 replaces a defective element in a row and/or column as follows. Row controller 708 and column controller 712 function substantially identically to controllers 604 (FIG. 6) and 206 (FIG. 2), respectively. Specifically, for a defective row (x), row controller 708 asserts a high control signal on row control lines 714(r), for all r<x, and a low control signal on row control lines 714(r), for all r≧x. Similarly, for a defective column (y), column controller 712 asserts a high control signal on column control lines 710(c), for all c<y, and a low control signal on column control lines 710(c), for all c≧x.

A given primary switch 720(r,c) replaces a defective element in a row or column by responding to the different combinations of control signals asserted on row control line 714(r) and column control line 710(c) as follows. If both signals are high, then row (r) and column (c) are unaffected by row or column replacement, and switch 720 couples pixel electrode 716(r,c) with primary storage element 718(r,c). When replacing a defective column only, the signal asserted on column control line 710(c) is low and the signal asserted on row control line 714(r) is high, causing primary switch 720 to couple pixel electrode 716(r,c) with primary storage element 718(r,c+1).

Row replacement is slightly more complex. When replacing elements in a defective row only, the signal asserted on column control line 710(c) is high and the signal asserted on row control line 714(r) is low, causing primary switch 720(r,c) to couple pixel electrode 716(r,c) with third input terminal 726(r,c), and to couple primary storage element 718(r,c) with second output terminal 730(r,c). Since a low control signal is being asserted on row control line 714(r), a low signal is also being asserted on control line 714(r+1), causing primary switch 720(r+1,c) to couple primary storage element 718(r+1,c) with second output terminal 730(r+1,c). Thus, pixel electrode 716(r,c) is coupled, via primary switches 720(r,c) and 720(r,c+1), with primary storage element 718(r+1,c).

When replacing defective elements of both a row and a column, the signals asserted on column control line 710(c) and row control line 714(r) are both low, causing primary switch 720(r,c) to couple pixel electrode 716(r,c) with third input terminal 726(r,c), and to couple primary storage element 718(r,c+1) with second output terminal 730(r,c). Since a low signal is being asserted on control line 714(r), a low signal is also being asserted on control line 714(r+1), causing primary switch 720(r+1,c) to couple primary storage element 718(r+1,c+1) with its second output terminal 730 (r+1,c). Thus, pixel electrode 716(r,c) is coupled, via primary switches 720(r,c) and 720(r+1,c), with primary storage element 718(r+1,c+1).

Figure 8:
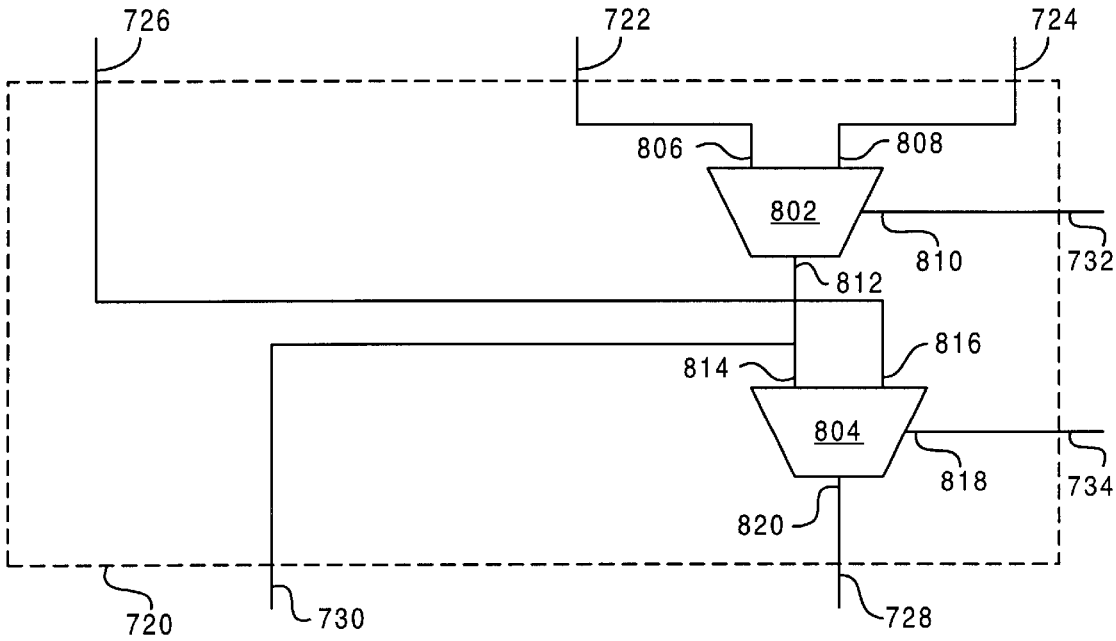
FIG. 8 is a schematic diagram of a switch shown in FIG. 7*a;*

FIG. 8, shows a primary switch 720 in greater detail to include a first multiplexer 802 and a second multiplexer 804. In one embodiment, each multiplexer 802 and 804 is substantially identical to switch 224(r,c), as shown in FIG. 4. First multiplexer 802 has a first input terminal 806 and a second input terminal 808 coupled to first input terminal 722 and second input terminal 724 of primary switch 720, respectively. First multiplexer 802 also has a control terminal 810 coupled to column control terminal 732, and an output terminal 812 coupled to second output terminal 730 of primary switch 720. Second multiplexer 804 has a first input terminal 814 coupled to output terminal 812 of first multiplexer 802, a second input terminal 816 coupled to third input terminal 726 of primary switch 720, a control terminal 818 coupled to row control terminal 734, and an output terminal 820 coupled to first output terminal 728 of primary switch 720.

Primary switch 720 performs the above described functions as follows. In the first case, high signals are asserted on both the column control terminal 732 and the row control terminal 734. In response to the high signal being asserted, via column control terminal 732, on its control terminal 810, first multiplexer 802 couples its first input terminal 806 with its output terminal 812, thus coupling first input terminal 722 with second output terminal 730. Next, second multiplexer 804, responsive to the high signal being asserted, via row control terminal 734, on its control terminal 818, couples its first input terminal 814 with its output terminal 820, thus coupling first input terminal 722, via multiplexers 802 and 804, with first output terminal 728.

During column shifting only, a low signal is asserted on column control terminal 732 and a high signal is asserted on row control terminal 734. Responsive to the low signal on its control terminal 810, first multiplexer 802 couples its second input terminal 808 with its output terminal 812, thus coupling second input terminal 724 with second output terminal 730. Responsive to the high signal on its control terminal 818, second multiplexer 804 couples its first input terminal 814 with its output terminal 820, thus coupling second input terminal 724, via multiplexers 802 and 804, with first output terminal 728.

During row shifting only, a high signal is asserted on column control terminal 732 and a low signal is asserted on row control terminal 734. Responsive to the high signal on its control terminal 810, first multiplexer 802 couples its first input terminal 806 with its output terminal 812, thus coupling first input terminal 722 with second output terminal 730. Responsive to the low signal on its control terminal 818, second multiplexer 804 couples its second input terminal 816 with its output terminal 820, thus coupling third input terminal 726 with first output terminal 728.

Finally, during both column and row shifting, low signals are asserted on both column control terminal 732 and row control terminal 730. Responsive to the low signal on its control terminal 810, first multiplexer 802 couples its second input terminal 808 with its output terminal 812, thus coupling second input terminal 724 with second output terminal 730. Responsive to the low signal on its control terminal 818, second multiplexer 804 couples its second input terminal 816 with its output terminal 820, thus coupling third input terminal 726, with first output terminal 728.

Those skilled in the art will recognize that primary switch 720 functions as a two level multiplexer, multiplexing columns at the first level, and multiplexing rows at the second. Furthermore, in the case of no row or column shifting, the coupling of first input terminal 722 with second output terminal 730 is irrelevant to the proper operation of display 700, and should not be considered a limiting characteristic of primary switch 720. Similarly, during column shifting only, the coupling of second input terminal 724 with second output terminal 730 is irrelevant to the proper operation of display 700, and should not be considered a limiting characteristic of primary switch 720. As used herein, the term "switch" encompasses any device capable of performing the essential couplings described.

Figure 9:
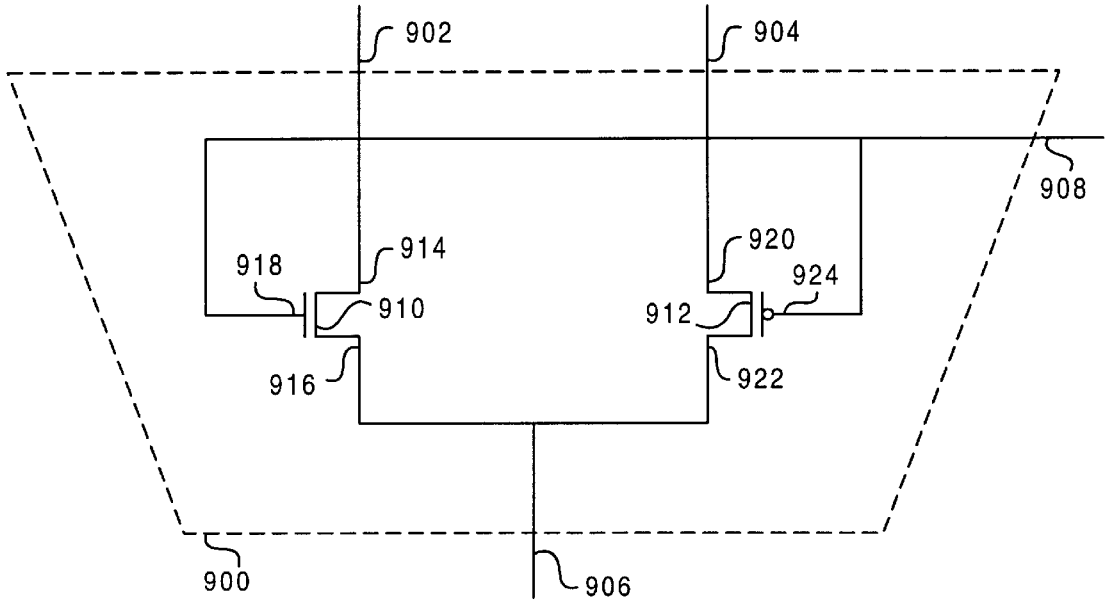
FIG. 9 is a schematic diagram of an alternate multiplexer, for use in the switch of FIG. 8.

FIG. 9 shows an alternate multiplexer 900 that may be substituted for each of multiplexers 802 and 804 of switch 706, or for switches 224(r,c) or 618(r,c). Multiplexer 900 includes a first input terminal 902, a second input terminal 904, an output terminal 906, a control terminal 908, an NMOS transistor 910, and a PMOS transistor 912. NMOS transistor 910 has a drain terminal 914 coupled to first input terminal 902, a source terminal 916 coupled to output terminal 906, and a gate terminal 918 coupled to control terminal 908. PMOS transistor 912 has a source terminal 920 coupled to second input terminal 904, a drain terminal 922 coupled to output terminal 906, and a gate terminal 924 coupled to control terminal 908.

Multiplexer 900 operates as follows. A high signal asserted on control terminal 908 turns NMOS transistor 910 on, and turns PMOS transistor 912 off, thus passing a signal asserted on first input terminal 902 to output terminal 906, and isolating output terminal 906 from second input terminal 904. On the other hand, a low signal asserted on control terminal 908 turns NMOS transistor 910 off, and turns PMOS transistor 912 on, thus passing a signal asserted on second input terminal 904 to output terminal 906, and isolating output terminal 906 from first input terminal 904.

The major advantage of multiplexer 900 is its simplicity. Since displays typically contain hundreds of thousands of switches, the elimination of a single device from each switch results in a substantial reduction in the device count of a display. Unlike transmission gates, however, multiplexer 900 would generally not be able to drive its output terminal 906 all the way to either of the circuit supply voltages. For example, consider the case when high signals are asserted on first input terminal 902 and control terminal 908. NMOS transistor 910 begins to conduct, raising the voltage on output terminal 906 toward that of the high signal being asserted on first input terminal 902, but when the difference between the voltage on output terminal 906 and the voltage on control terminal 908 is less than the threshold voltage of NMOS transistor 910, NMOS transistor 910 turns off. Thus, NMOS transistor 910 can only pull output terminal 906 up to within its threshold voltage of the high signal being asserted on control terminal 908. Similarly, PMOS transistor 912 can only pull output terminal 906 down to within its threshold voltage of a low signal being asserted on control terminal 908.

This limitation can be overcome, however, by driving control terminal 908 at voltages above and below the maximum and minimum values to be asserted on input terminals 902 and 904. For example, using means well known in the art, first supply terminal 502 of controller 206 (FIG. 5) can be pumped so as to exceed Vdd by at least the threshold voltage of NMOS transistor 910. Similarly, second supply terminal 508 can be pumped to a value of at least the threshold voltage of PMOS transistor 912 below ground. Multiplexer 900 would then be capable of driving output terminal 906 at any voltage between Vdd and ground.

Figure 10:
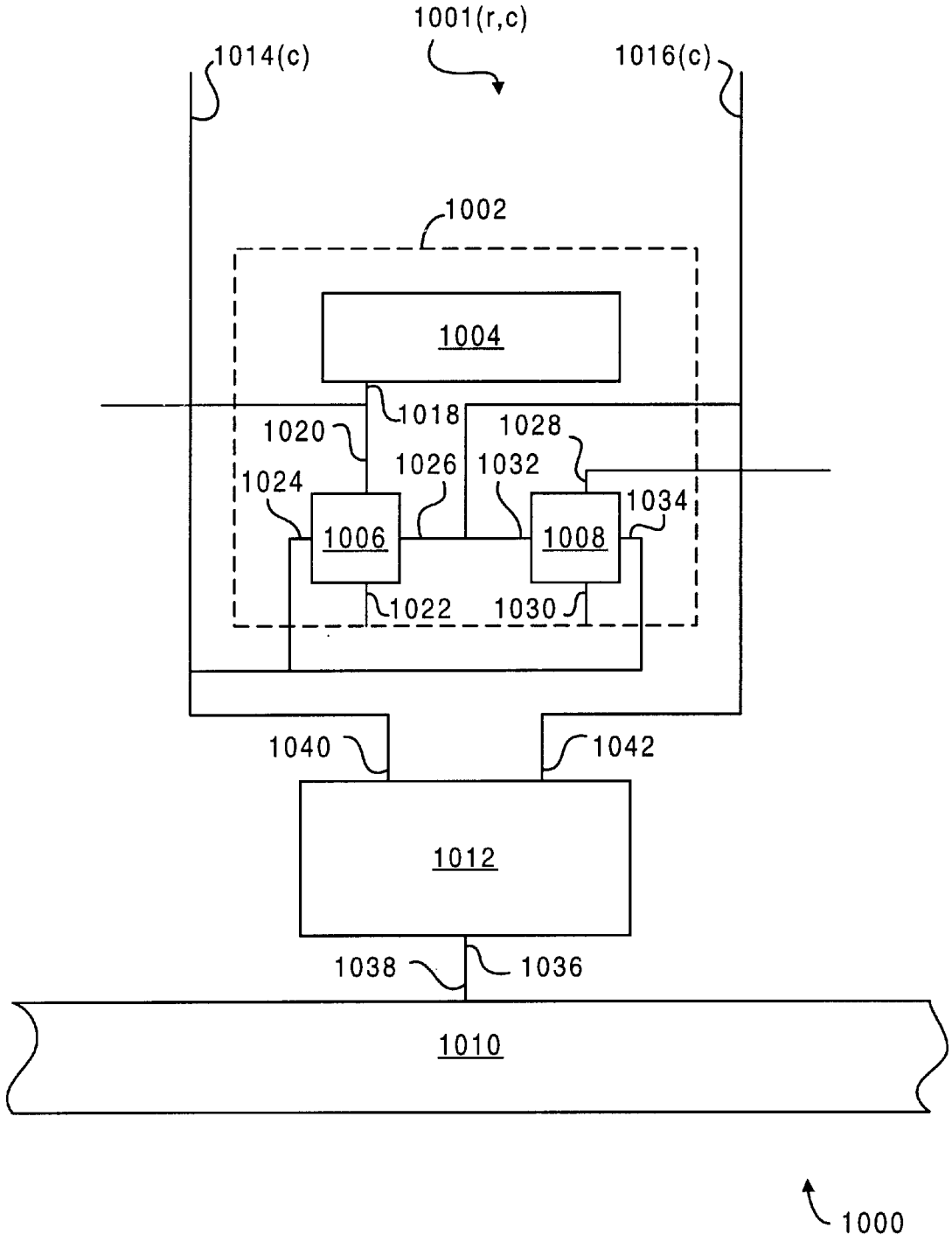
FIG. 10 is a block diagram of a portion of a flat panel display in accordance with a fourth embodiment of the present invention.

The device count of a display can also be reduced by employing additional control lines. For example, FIG. 10 shows one pixel cell 1001 (r,c) of an alternate display 1000, employing dual control lines. Pixel cell 1001 (r,c) includes a pixel electrode 1002, a primary storage element 1004, a first switch 1006, and a second switch 1008. Display 1000 further includes a controller 1010, and an activator 1012(c), a first control line 1014(c), and a second control line 1016(c), for each column (c) in display 1000. Display 1000 also includes data lines and row-select lines, but they are omitted from FIG. 10 for clarity.

Primary storage element 1004 has a data output terminal 1018. Switch 1006(r,c) has an input terminal 1020 coupled to data output terminal 1018, an output terminal 1022 coupled to pixel electrode 1002, a first control terminal 1024 coupled to first control line 1014(c), and a second control terminal 1026 coupled to second control line 1016(c). Second switch 1008 has an input terminal 1028 coupled to a storage element 1004 of an adjacent pixel cell 1001(r,c+1) (not shown), an output terminal 1030 coupled to pixel electrode 1002, a first control terminal 1032 coupled to second control line 1016(c), and a second control terminal 1034 coupled to first control line 1014(c).

Activator 1012 has an input terminal 1036 coupled to a control output terminal 1038 of controller 1010, a first output terminal 1040 coupled to first control line 1014(c), and a second output terminal 1042 coupled to second control line 1016(c). Responsive to controller 1010 asserting a first (high) signal on input terminal 1036, activator 1012 asserts a low signal on first output terminal 1040 and a high signal on second output terminal 1042. Responsive to controller 1010 asserting a second (low) signal on input terminal 1036, activator 1012 asserts a high signal on first output terminal 1040 and a low signal on second output terminal 1042. Thus, activator 1012 asserts complimentary signals on control lines 1014(c) and 1016(c). That is, when a high signal is asserted on control line 1014, a low signal is asserted on control line 1016, and vice versa.

Switch 1006 functions as follows. When a high signal is asserted on first control terminal 1024 and a low signal is asserted on second control terminal 1026, switch 1006 isolates input terminal 1020 from output terminal 1022. On the other hand, when a low signal is asserted on first control terminal 1024 and a high signal is asserted on second control terminal 1026, switch 1006 passes a signal asserted on input terminal 1020 to output terminal 1022. Thus, switch 1006 selectively couples storage element 1004(r,c) with pixel electrode 1002(r,c). Switch 1008 is substantially identical to switch 1006, and selectively couples pixel electrode 1002 (r,c) with adjacent storage element 1004(r,c+1).

Because first control terminals 1024 and 1032 and second control terminals 1026 and 1034 of switches 1006 and 1008, respectively, are oppositely coupled to control lines 1014(c) and 1016(c), only one of switches 1006 and 1008 are in a conducting state at a time. Thus when switch 1006 couples pixel electrode 1002(r,c) with storage element 1004(r,c), switch 1008 is isolating pixel electrode 1002(r,c) from adjacent storage element 1004(r,c+1), and vice versa.

Figure 11:
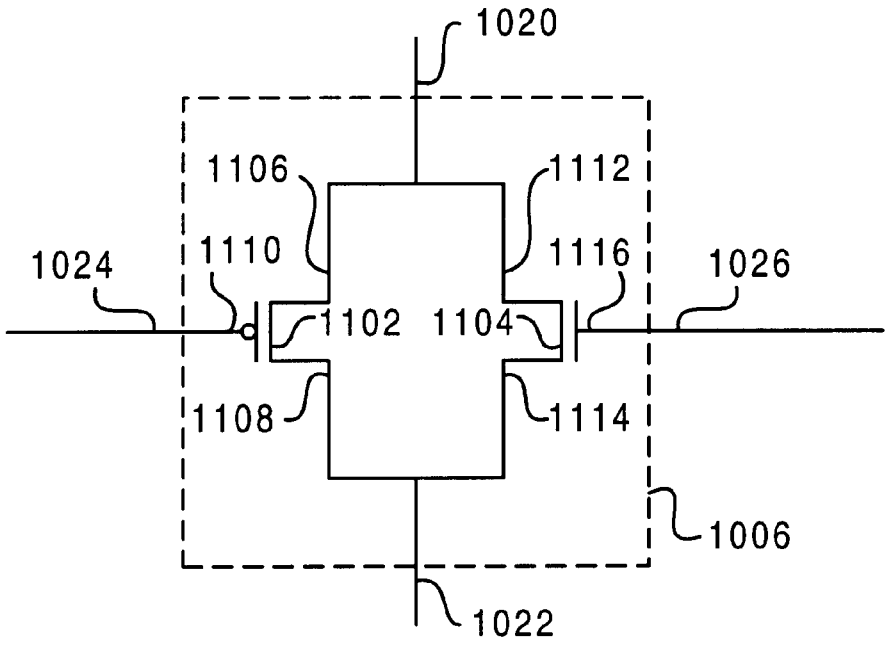
FIG. 11 is a schematic diagram of a switch shown in the display of FIG. 10.

FIG. 11 shows switch 1006 in greater detail to include a PMOS transistor 1102 and an NMOS transistor 1104. PMOS transistor 1102 has a source terminal 1106 coupled to input terminal 1020, a drain terminal 1108 coupled to output terminal 1022 and a gate terminal 1110 coupled to first control terminal 1024. NMOS transistor 1104 has a drain terminal 1112 coupled to input terminal 1020, a source terminal 1114 coupled to output terminal 1022, and a gate terminal 1116 coupled to second control terminal 1026. Those skilled in the art will recognize this embodiment of switch 1006 as a CMOS transmission gate.

Figure 12:
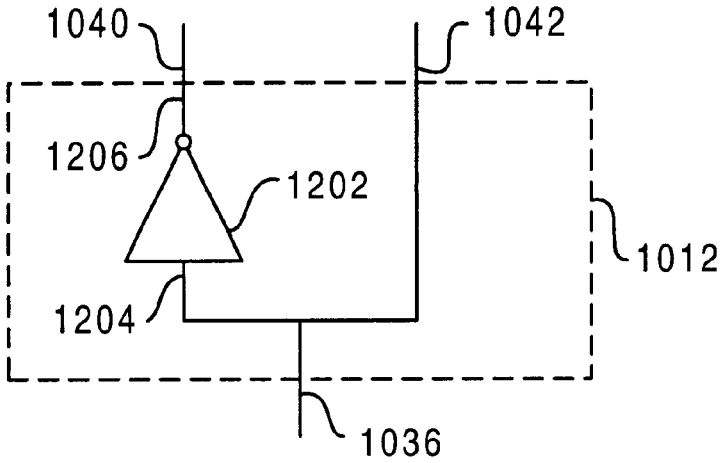
FIG. 12 is a schematic diagram of an activator shown in the display of FIG. 10.

FIG. 12 shows activator 1012 in greater detail to include an inverter 1202, having an input terminal 1204 coupled to input terminal 1036, and an output terminal 1206 coupled to first output terminal 1040. Input terminal 1036 is coupled directly to second output terminal 1042. Thus, when controller 1010 asserts a signal on input terminal 1036, the signal is communicated directly to second output terminal 1042, and the inverse of the signal is asserted on first output terminal 1040.

Comparing, for example, switch 224(r,c) (FIG. 4) with switch 1006, the reduction in device count associated with the use of complimentary pairs of control lines is readily apparent. Specifically, the need for inverters 406 and 412 in the transmission gates of switch 224(r,c) could be eliminated by directly coupling gate terminals 424 and 430 with one control line and gate terminals 414 and 440 with a second complimentary control line. Thus, the single inverter of activator 1012 eliminates the need for inverters in an entire column of switches. Furthermore, the use of complimentary pairs of control lines is equally applicable to displays employing row redundancy and, because multiplexers 802 and 804 of primary switch 720 are identical to switch 224(r,c), to displays employing a combination of row and column redundancy.

The description of the present invention with reference to several embodiments is now complete. Many of the described features may be substituted, altered or omitted, without departing from the scope of the invention. For example, the invention may be practiced using transmissive rather than reflective pixel electrodes, capacitative storage elements could be employed to facilitate the use of analog data, or bi-polar devices could be used to construct the switches. Furthermore, those skilled in the art will recognize that NMOS and PMOS transistors are capable of bidirectional operation, and, therefore, the drain and source terminals of the NMOS and PMOS devices may be interchanged.

I claim:

1. A display having a plurality of pixel cells arranged in columns and rows, each of said pixel cells comprising:

a pixel electrode;

a storage element; and a first switch for selectively coupling said pixel electrode to said storage element of said pixel cell and a storage element of a second one of said pixel cells in an adjacent row or column;

whereby, once said pixel electrode is coupled to said storage element of said second one of said pixel cells, said storage element of said second one of said pixel cells replaces said storage element to receive data intended for said storage element and to provide said data stored in said storage element of said second one of said pixel cells to said pixel electrode when the row or column of said pixel cells is defective, said storage element arranged in said defective row or column of said pixel cells.

2. A display in accordance with claim 1, wherein said pixel electrodes are reflective electrodes.

3. A display in accordance with claim 2, wherein said reflective electrodes comprise metallic mirrors.

4. A display in accordance with claim 1, wherein at least one of said storage elements comprises a latch.

5. A display in accordance with claim 1, wherein said first switch comprises a multiplexer.

6. A display in accordance with claim 5, wherein said multiplexer comprises:

a first input terminal coupled to said storage element of said one of said pixel cells;

a second input terminal coupled to said storage element of said second one of said pixel cells;

an output terminal coupled to said pixel electrode;

a control terminal;

a transistor of a first conductivity type having a first current handling terminal coupled to said first input terminal, a second current handling terminal coupled to said output terminal, and a gate terminal coupled to said control terminal; and a transistor of a second opposite conductivity type having a first current handling terminal coupled to said second input terminal, a second current handling terminal coupled to said output terminal, and a gate terminal coupled to said control terminal.

7. A display in accordance with claim 1, further comprising a controller coupled to said switch.

8. A display in accordance with claim 7, wherein said controller comprises a register.

9. A display in accordance with claim 7, wherein said controller comprises:

a first voltage supply terminal;

a second voltage supply terminal;

a fuse having a first terminal coupled to said first voltage supply terminal, and a second terminal coupled to said switch; and a terminator having a first terminal coupled to said second terminal of said fuse, and a second terminal coupled to said second voltage supply terminal.

10. A display in accordance with claim 9, wherein said terminator comprises:

a first transistor of a first conductivity type having a gate terminal for resetting said terminator, a first current handling terminal coupled to said first terminal of said terminator, and a second current handling terminal coupled to said second voltage supply terminal;

a second transistor of said first conductivity type having a gate terminal, a first current handling terminal coupled to said first terminal of said terminator, and a second current handling terminal coupled to said second voltage supply terminal; and an inverter having an input terminal coupled to said first terminal of said terminator, and an output terminal coupled to said gate terminal of said second transistor.

11. A display in accordance with claim 7, further comprising a router coupled to said storage element of said second one of said pixel cells for redirecting signals intended for said storage element of said one of said pixel cells to said storage element of said second one of said pixel cells.

12. A display in accordance with claim 11, wherein:

said pixel electrode is a reflective electrode;

at least one of said storage elements comprises a latch;

said switch comprises a multiplexer, including an output terminal coupled to said pixel electrode, a first input terminal coupled to said storage element of said one of said pixel cells, a second input terminal coupled to said storage element of said second one of said pixel cells, and a control terminal;

said controller comprises a register including an output terminal coupled to said control terminal of said multiplexer; and said router comprises a first signal input terminal, a second signal input terminal, a signal output terminal coupled to said storage element of said second one of said pixel cells; and a switch coupled to said first signal input terminal, said second signal input terminal, and said signal output terminal, for selectively coupling said signal output terminal with said first and second signal input terminals.

13. A display in accordance with claim 11, wherein said router is further coupled to said controller to coordinate said redirection of signals with said selective coupling of said pixel electrode and said storage element of said second one of said pixel cells.

14. A display in accordance with claim 13, wherein said redirected signals comprise data.

15. A display in accordance with claim 13, wherein said redirected signals comprise row-select signals.

16. A display in accordance with claim 1, further comprising a router coupled to said storage element of said second one of said pixel cells for selectively redirecting data intended for said storage element of said one of said pixel cells to said storage element of said second one of said pixel cells.

17. A display in accordance with claim 16, wherein said router comprises:

a first data input terminal; a a second data input terminal;

a data output terminal coupled to said storage element of said second one of said pixel cells; and a switch coupled to said first data input terminal, said second data input terminal, and said data output terminal, for selectively coupling said data output terminal with said first and second data input terminals.

18. A display in accordance with claim 17, wherein said switch of said router comprises a multiplexer.

19. A display in accordance with claim 1, further comprising a second switch selectively coupling said pixel electrode to a storage element of a third one of said pixel cells, via said first switch.

20. A display in accordance with claim 19, wherein said second switch selectively couples said pixel electrode to a storage element of a fourth one of said pixel cells, via said first switch.

21. A display in accordance with claim 20, wherein:

said first switch comprises a first input terminal coupled to said storage element of said one of said pixel cells, a second input terminal coupled to said storage element of said second one of said pixel cells, a third input terminal, and an output terminal coupled to said pixel electrode; and said second switch comprises a first input terminal coupled to said storage element of said third one of said pixel cells, a second input terminal coupled to said storage element of said fourth one of said pixel cells, and an output terminal coupled to said third input terminal of said first switch.

22. A display in accordance with claim 21, further comprising:

a first controller coupled to said first and said second switches; and a second controller coupled to said first and said second switches.

23. A display in accordance with claim 22, wherein said first switch further comprises:

a first multiplexer having a first input terminal coupled to said first input terminal of said first switch, a second input terminal coupled to said second input terminal of said first switch, a control terminal coupled to said first controller, and an output terminal; and a second multiplexer having a first input terminal coupled to said output terminal of said first multiplexer, a second input terminal coupled to said third input terminal of said first switch, a control terminal coupled to said second controller, and an output terminal coupled to said output terminal of said first switch.

24. A display in accordance with claim 22, wherein said second switch further comprises:

a first multiplexer having a first input terminal coupled to said first input terminal of said second switch, a second input terminal coupled to said second input terminal of said second switch, a control terminal coupled to said first controller, and an output terminal coupled to said output terminal of said second switch.

25. A display in accordance with claim 24, wherein at least one of said multiplexers comprises:

a first transistor of a first conductivity type having a first current handling terminal coupled to said first input terminal of said multiplexer, a second current handling terminal coupled to said output terminal of said multiplexer, and a gate terminal coupled to said control terminal of said multiplexer; and a transistor of a second opposite conductivity type having a first current handling terminal coupled to said second input terminal of said multiplexer, a second current handling terminal coupled to said output terminal of said multiplexer, and a gate terminal coupled to said control terminal of said multiplexer.

26. A display in accordance with claim 22, further comprising:

a data router coupled to each of said storage elements, for selectively redirecting data from said storage elements of said first and third ones of said pixel cells to said storage elements of said second and fourth ones of said pixel cells; and a row-select router coupled to each of said storage elements for selectively redirecting row-select signals from said storage elements of said first and second ones of said pixel cells to said storage elements of said third and fourth ones of said pixel cells.

27. A display comprising:

a plurality of pixel electrodes arranged in columns and rows;

a plurality of storage elements arranged in columns and rows, each of said pixel electrodes being associated with a respective one of said storage elements;

a plurality of switches, each of said switches selectively coupling one of said pixel electrodes with at least two of said storage elements, said at least two storage elements being associated with different ones of said pixel electrodes;

whereby, defective rows or columns can be replaced by dissociating each of said pixel electrodes of a defective row or column from said storage elements of said defective row or column and reassociating said pixel electrodes with storage elements of another row or column, said storage elements of said another row or column replacing said storage elements of said defective row or column to receive data intended for said storage elements of said defective row or column and to provide said data stored in said storage elements of said another row or column to said pixel electrodes of said defective row or column.

28. A display according to claim 27, wherein said plurality of storage elements comprises:

a group of primary storage elements, each being associated with one of said pixel electrodes; and a group of redundant storage elements.

29. A display according to claim 28, wherein said display comprises:

an array of cells, each cell including one of said pixel electrodes, said primary storage element associated with said pixel electrode, and one of said switches selectively coupling said pixel electrode with said associated primary storage element; and an array of said redundant storage elements disposed adjacent said array of cells.

30. A display according claim 29, wherein said switches selectively couple said pixel electrodes with at least one of said storage elements adjacent said associated primary storage element.

31. A display according to claim 30, wherein:

said display further comprises a first controller, including a plurality of output terminals;

each of said switches includes a first control terminal coupled to one of said output terminals of said first controller;

responsive to a first signal asserted on said first control terminal by said first controller, each of said switches couples said pixel electrode with said primary storage element associated with said pixel electrode; and responsive to a second signal on said first control terminal, each of said switches couples said pixel electrode with said adjacent storage element.

32. A display according to claim 31, wherein:

said display further comprises a second controller, including a plurality of output terminals;

each of said switches includes a second control terminal coupled to one of said output terminals of said second controller;

responsive to a first signal asserted on said first and second control terminals, said switches couple said pixel electrodes with said primary storage elements associated with said pixel electrodes;

responsive to a first signal being asserted on said first control terminal and a second signal being asserted on said second control terminal, said switches couple said pixel electrodes with different adjacent storage elements; and responsive to a second signal being asserted on said first and second control terminals, said switches couple said pixel electrodes, through an adjacent switch, with a further, different adjacent storage element.

33. A display according to claim 32, wherein:

each of said output terminals of said first controller is coupled to the control terminals of switches of cells defining a column in said array of cells; and each of said output terminals of said second controller is coupled to the control terminals of switches of cells defining a row in said array of cells.

34. A display according to claim 33, further comprising:

a first router, coupled to said plurality of control terminals of said first controller, for redirecting signals from a first column to an adjacent column, responsive to a signal being asserted on a control terminal of said first controller associated with said first column; and a second router, coupled to said plurality of control terminals of said second controller, for redirecting signals from a first row to an adjacent row, responsive to a signal being asserted on a control terminal of said second controller associated with said first row.

35. A method for replacing a defective element in a flat-panel display comprising the steps of:

receiving control signals;

coupling a pixel electrode with a first storage element primarily associated with said pixel electrode, responsive to a first control signal; and decoupling said pixel electrode from said first storage element and coupling said pixel electrode with a second storage element primarily associated with a second pixel electrode, responsive to a second control signal, to replace defective elements associated with said first storage element with elements previously associated with said second storage element; whereby said second storage element receives data intented for said storage element and provide said received data to said pixel electrode.

36. A method according to claim 35, further comprising the steps of:

receiving data to be displayed on said pixel electrode; and redirecting said data to said second storage element, responsive to said second control signal.

37. A method according to claim 35, further comprising the steps of:

decoupling said pixel electrode from said first storage element and said second storage element, responsive to a third control signal; and coupling said pixel electrode with a third storage element primarily associated with a third pixel electrode, responsive to said third control signal.

38. A method according to claim 37, further comprising the step of redirecting row select signals from said first storage element to said third storage element, responsive to said third control signal.

39. A method according to claim 37, further comprising the steps of:

decoupling said pixel electrode from said first storage element, said second storage element, and said third storage element, responsive to a fourth control signal; and coupling said pixel electrode with a fourth storage element primarily associated with a fourth pixel electrode, responsive to said fourth control signal.

40. A method according to claim 39 further comprising the steps of:

redirecting said data to said fourth storage element, responsive to said fourth control signal; and redirecting said row select signals from said first storage element to said fourth storage element, responsive to said fourth control signal.

* * * * *